US011813887B2

(12) United States Patent
Skinner et al.

(10) Patent No.: US 11,813,887 B2
(45) Date of Patent: Nov. 14, 2023

(54) WICKING NIB DEVICE AND SYSTEM

(71) Applicant: CRAYOLA LLC, Easton, PA (US)

(72) Inventors: Craig Skinner, Nazareth, PA (US); Scott Collins, Nazareth, PA (US); Richard Kuiken, Columbia, NJ (US); Anthony P. Monzo, Easton, PA (US); Jake Towne, Easton, PA (US); Keith Allison, Blandon, PA (US)

(73) Assignee: CRAYOLA LLC, Easton, PA (US)

( * ) Notice: Subject to any disclaimer, the term of this patent is extended or adjusted under 35 U.S.C. 154(b) by 0 days.

(21) Appl. No.: 17/958,664

(22) Filed: Oct. 3, 2022

(65) Prior Publication Data

US 2023/0027704 A1 Jan. 26, 2023

Related U.S. Application Data

(62) Division of application No. 17/243,153, filed on Apr. 28, 2021, now Pat. No. 11,472,219.

(60) Provisional application No. 63/016,645, filed on Apr. 28, 2020.

(51) Int. Cl.

| | |
|---|---|
| ***B43K 1/00*** | (2006.01) |
| ***B43K 1/01*** | (2006.01) |
| ***B43K 11/00*** | (2006.01) |

(52) U.S. Cl.

CPC ..... *B43K 1/003* (2013.01); *B43K 1/01* (2013.01); *B43K 11/005* (2013.01)

(58) Field of Classification Search

CPC ..... B43K 1/12; B43K 11/00; B43K 11/005; B43K 1/003; B43K 1/006; B43K 1/01; B43K 23/06; B43L 25/008; B43L 25/10

See application file for complete search history.

(56) References Cited

U.S. PATENT DOCUMENTS

| | | | | | |
|---|---|---|---|---|---|
| 789,534 | A * | 5/1905 | Gillespie | B43L 25/10 | 15/257.076 |
| 4,614,163 | A * | 9/1986 | Hetzer | B43K 11/005 | 118/268 |
| 5,678,940 | A * | 10/1997 | Moeck | B43L 25/10 | 401/206 |
| 7,004,660 | B2 * | 2/2006 | Kaempf | B43K 8/026 | 401/198 |
| 9,193,212 | B2 * | 11/2015 | Henry | B43K 15/00 | |
| 11,472,219 | B2 * | 10/2022 | Skinner | B43K 23/06 | |
| 2021/0245545 | A1 * | 8/2021 | Henry | D21H 21/28 | |

FOREIGN PATENT DOCUMENTS

| | | | | |
|---|---|---|---|---|
| GB | 2243995 | A * | 11/1991 | B43K 1/12 |
| KR | 20160028878 | A * | 3/2016 | B43K 11/00 |

* cited by examiner

*Primary Examiner* — David P Angwin
*Assistant Examiner* — Bradley S Oliver
(74) *Attorney, Agent, or Firm* — STINSON LLP

(57) ABSTRACT

The technology described herein relates to a system and device for saturating an absorbent wicking nib with colored ink supplied by an ink pad having a well configured to receive a portion of the sidewall of the nib. Different colors of ink can be transferred to different portions of the nib sidewall to result in a multicolor marker nib.

8 Claims, 34 Drawing Sheets

WICKING NIB DEVICE AND SYSTEM

CROSS REFERENCE TO RELATED APPLICATIONS

This application claims priority to and is a Divisional of U.S. patent application Ser. No. 17/243,153, filed Apr. 28, 2021, which is based on and claims priority to U.S. Provisional Application No. 63/016,645, filed Apr. 28, 2020, each of which is incorporated herein by reference in its entirety.

FIELD

Aspects of the technology described herein relate to a positioning device for orienting an absorbent marking instrument directly adjacent a plurality of ink sources to facilitate fluid transfer. In further aspects, embodiments of the technology described herein relate to a wicking nib device configured to orient the saturated marking nibs of at least two different-colored, saturated marker nibs directly adjacent portions of a porous wicking nib, such that the porous wicking nib simultaneously wicks ink from both contacted marker nibs to create a multi-color marking nib. In additional aspects, embodiments of the technology described herein relate to a system or kit for making a multi-color marking nib, as well as methods of making and using a multi-color marking nib.

BACKGROUND

Color-transfer mechanisms for direct nib-to-nib ink transfer typically orient the donating nib along the same axis as the recipient nib. In such systems, the barrel, reservoir, marker housing, marker collar, and marker nib are generally aligned along the same axis with only the tip of one marker nib contacting the tip of the other.

BRIEF SUMMARY

This Summary is provided to introduce a selection of concepts in a simplified form that are further described below in the Detailed Description. This Summary is not intended to identify key features or essential components of the claimed subject matter, nor is it intended to be used as an aid in determining the scope of the claimed subject matter. The technology described herein generally relates to a wicking nib device configured to orient the saturated marking nibs of two different-colored, saturated marker nibs directly adjacent opposing portions of a porous wicking nib, such that the porous wicking nib simultaneously wicks ink from both contacted marker nibs to create a dual-color marking nib.

Thus, provided herein is a wicking nib system comprising at least one wicking nib component and a base housing, wherein the base housing comprises a wicking nib positioner having a central axis extending vertically therethrough and at least one marker positioner, wherein a central axis of the at least one marker positioner is at an acute angle relative to the central axis of the wicking nib positioner, and wherein the at least one marker positioner is configured to secure a saturated marker nib of at least one marker immediately adjacent and in contact with a portion of a sidewall of the wicking nib component.

Also provided herein is a multi-color marker maker comprising an unsaturated marker nib, a first color donor, and a second color donor, wherein the first color donor is releasably coupled to the second color donor along at least one mating edge on the first color donor and at least one mating edge on the second color donor; wherein each of the first color donor and the second color donor include a well located thereon, wherein the combination of the well of the first color donor and the well of the second color donor define a positioning aperture; and wherein the positioning aperture is sized and shaped to receive the unsaturated marker nib with a first portion of a sidewall of the unsaturated marker nib in contact with the first color donor and a second portion of the sidewall of the unsaturated marker nib in contact with the second color donor.

Further provided herein is a marker refilling station comprising a housing comprising a plurality of ink chambers sized to receive a sufficient amount of ink to refill a marker nib; and a plurality of marker collars coupled to the plurality of ink chambers, wherein the marker collar is oriented such that when a marker is placed therein, the marker is generally vertical in orientation; and a plurality of ink bottles.

Other objects and features will be in part apparent and in part pointed out hereinafter.

BRIEF DESCRIPTION OF THE SEVERAL VIEWS OF THE DRAWING

The technology described herein is described in detail below with reference to the attached drawing figures, wherein.

Corresponding reference characters indicate corresponding parts throughout the drawings.

DETAILED DESCRIPTION OF THE INVENTION

Aspects of the technology described herein will become more apparent with reference to the figures provided herein.

Certain embodiments of the wicking nib device comprise a wicking nib positioner in a first position, a first colored marker in a second position, and a second colored marker in a third position. In some aspects, the first colored marker and the second colored marker are oriented in a single plane with the housing of the wicking nib (such as the housing or barrel of a wicking nib marker), and a central axis of each of the colored markers is oriented at opposing and mirrored angles with respect to the central axis of the wicking nib. Based on orientation, contact between the first and second colored markers and the wicking nib may be simultaneous, holding each of the saturated marker nibs directly adjacent the wicking nib so that both colors of marker ink are transferred into the wicking nib. In some aspects, the wicking nib is configured to receive proportionate amounts of each of the marker colors, to provide a dual-color marker that can deposit one or more colors onto a marking surface.

In further aspects of the invention, the wicking nib device may be used to quickly create a marker with a nib that is customized with two or more different colored inks. During drawing with that wicking nib, after saturation with the two different inks, the wicking nib can be used to mark with a single color from one portion of the nib, a single color from another portion of the nib, or a two-color marking from a combined portion of the nib where both ink colors are transferred onto the marking surface. In some aspects, the marker boundary between the two wicked inks may begin to blend colors, creating a third color between the adjacent, saturated zones of the wicking nib. In further aspects, over time, the wicking nib may combine greater and greater concentrations of the adjacent ink colors at a boundary near an approximate midpoint between the two, absorbed colors.

Figure 1A:
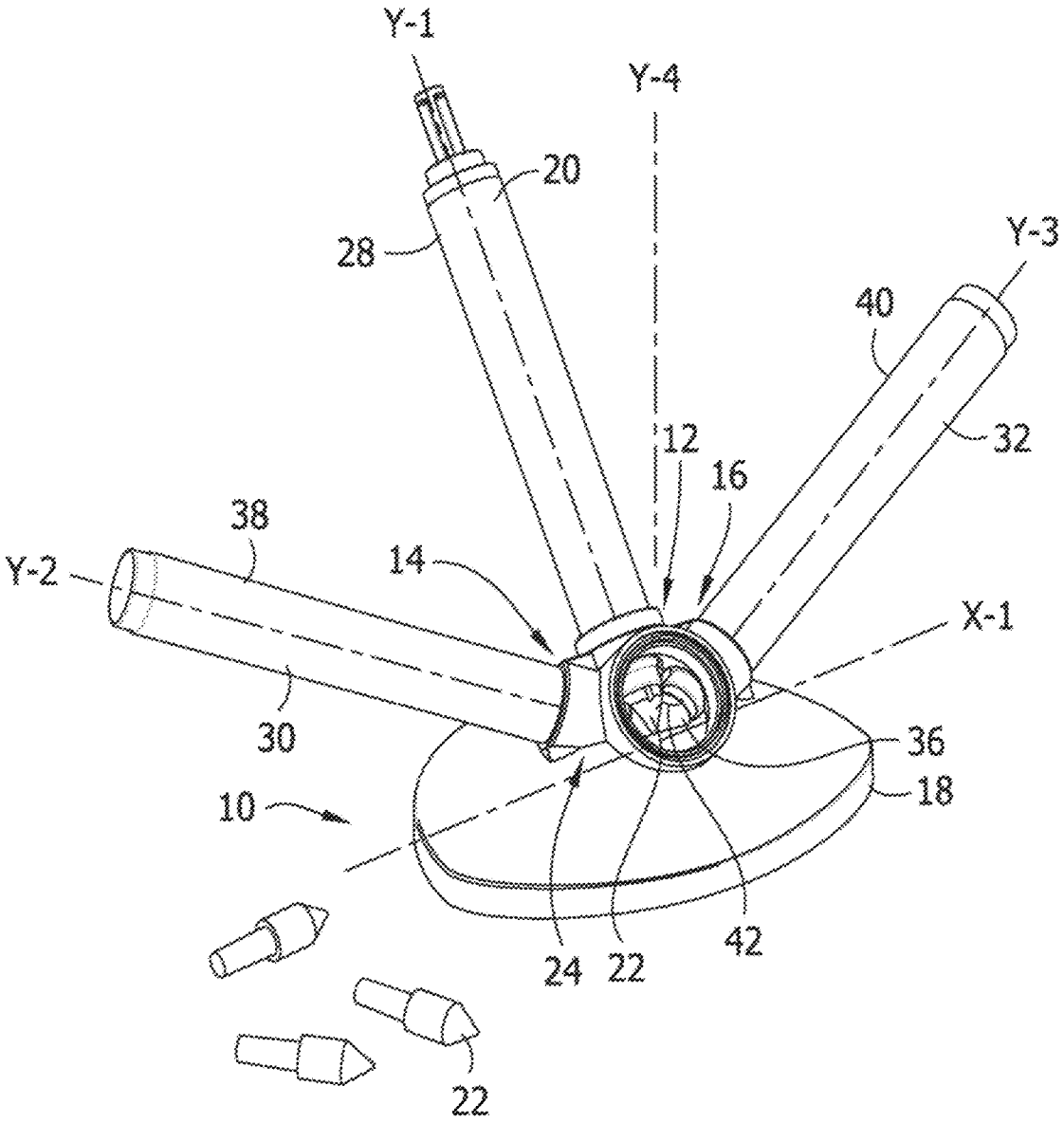
FIG. 1*a* is a perspective view of a wicking nib device in accordance with a first exemplary embodiment wherein a wicking marker having a wicking nib and two colored markers each having donating nibs are positioned within the wicking nib device.
Figure 1B:
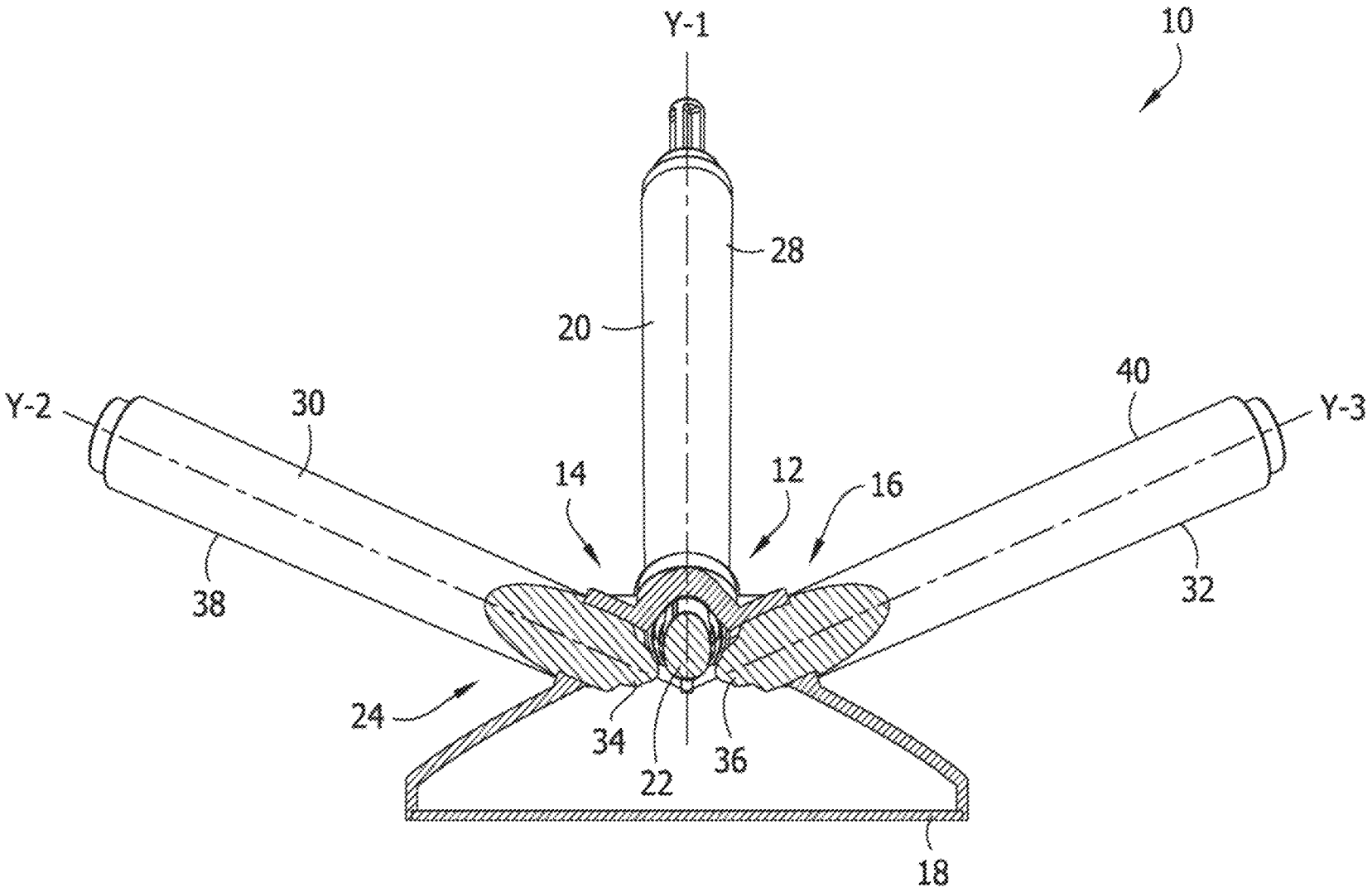
FIG. 1*b* is a cross-sectional view of the wicking nib device of FIG. 1*a* taken along line 1-1.
Figure 1C:
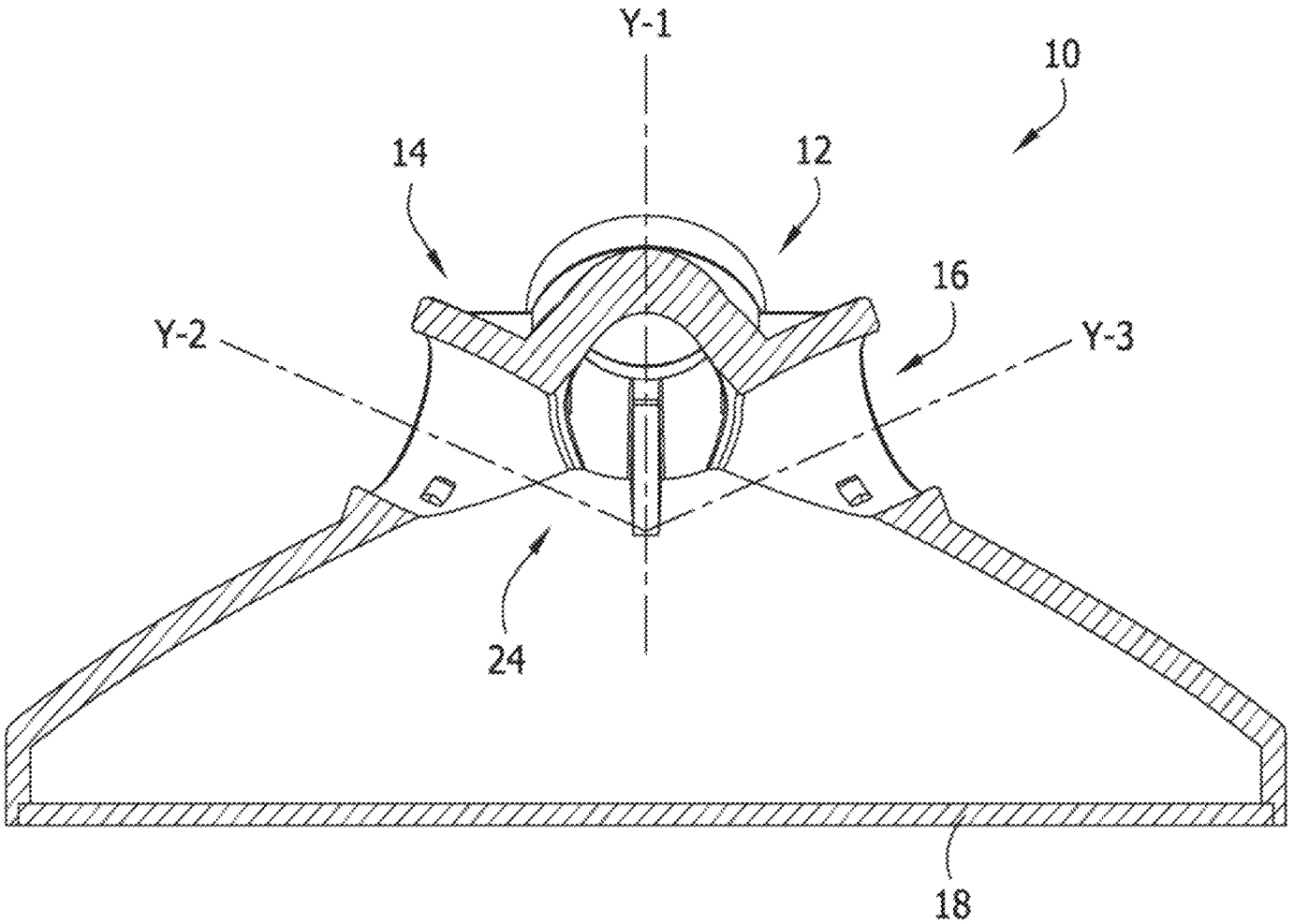
FIG. 1*c* is a cross-sectional view of the wicking nib device of FIG. 1*a* taken along line 1-1 without the wicking marker and colored markers.

With reference now to FIGS. 1*a*-1*c*, an exemplary wicking nib device is generally designated by the numeral 10. Wicking nib device includes tubular wicking nib positioner 12, tubular first marker holder 14, and tubular second marker holder 16 extending upwardly from base 18 within a single plane relative to the base 18. Wicking nib positioner 12 is positioned between marker holders 14 and 16, and has a central vertical axis y-1 that extends generally perpendicular or at about a 90 degree angle relative to the horizontal axis x-1 of base 18. The central vertical axes y-2 and y-3 of marker holders 14 and 16 respectively extend at opposing and mirrored acute angles relative to the central vertical axis y-1 of positioner 12 such that vertical axes y-2 and y-3 intersect each other and intersect vertical axis y-1 at a point below positioner 12 and marker holders 14, 16. In some embodiments, central axes y-2 and y-3 extend at an angle relative to central axis y-1 of at least about 30 degrees (for example from about 30 degrees to about 80 degrees). As discussed more fully hereafter, the angle of central axes y-2 and y-3 will vary depending on the size and angle of the unsaturated wicking nib and the marker nibs.

Wicking nib positioner 12 is generally upright, though not strictly vertical. For example, as shown in FIG. 1, positioner 12 extends rearward at a slight angle from base 18 such that it is not aligned or parallel the central vertical axis y-4 of base 18. Marker holders 14, 16 are generally aligned in the same plane as positioner 12 such that they also are tilted at an angle rearward from base 18.

As shown in FIGS. 1*b* and 1*c*, positioner 12 is configured to retain the nib end of a wicking marker 20 such that the unsaturated wicking nib 22 extends downwardly through the bottom of positioner 12 into a wicking chamber 24 with the tip end of the nib facing down. Tubular positioner 12 has a diameter only slightly larger than the diameter of barrel 28 such that the nib end of the barrel may be received and held within positioner 12 in alignment with central vertical axis y-1 to properly position the wicking nib 22 within the wicking chamber 24. Positioner 12 may additionally include an inwardly extending collar (not shown) along the bottom edge of positioner against which the nib end of the wicking marker barrel 28 may be seated to keep the barrel 28 from extending into wicking chamber 24.

Similarly, marker holders 14, 16 are configured to retain the nib end of first and second donating markers 30, 32 respectively such that the first and second donating nibs 34, 36 extend generally downwardly through the bottoms of marker holders 14, 16 respectively into wicking chamber 24. Marker holders 14, 16 each have a diameter only slightly larger than the diameter of the respective donating marker barrel 38, 40 such that the nib end of each barrel may be received and held within the respective marker holder 14, 16 in alignment with central vertical axes y-2, y-3 respectively to properly position the donating nibs 34, 36 within wicking chamber 24. Marker holders 14, 16 may additionally include inwardly extending collars (not shown) respectively along the bottom edge of the marker holders against which the nib end of the respective donating marker barrels 38, 40 may be seated to keep the donating marker barrels 38, 40 from extending into wicking chamber 24. Donating nibs are saturated with a colored dye, colored ink, or other colored solution that can be transferred via diffusion or wicking action to the wicking nib upon contact with the wicking nib.

As best depicted in FIG. 1*b*, when wicking marker 20 and first and second donating markers 30, 32 are positioned within positioner 12 and marker holders 14, 16 respectively, wicking nib 22 is positioned within wicking chamber 24 between donating nibs 34, 36 with the donating nibs immediately adjacent and in contact with opposing sides of wicking nib 22 respectively. Due to this orientation, contact between the saturated donating nibs 34, 36 of the first and second markers 30, 32 and the unsaturated wicking nib 22 of the wicking marker 20 may be simultaneous, holding the nibs of the first and second markers 30, 32 directly adjacent the wicking nib 20 so that both colors of marker ink of the first and second markers 30, 32 are transferred into the wicking nib 20. Specifically, a side surface of each donating nib 34, 36 (e.g., a surface of the nib extending from the tip end upward a distance toward the base end of the nib) contacts opposing side surfaces of the wicking nib 22. The angle described above of the central axes y-2 and y-3 of the marker holders 14, 16 and thereby the donating nibs in relation to the central axis y-1 of the positioner 12 and thereby the wicking nib 22 allows for this contact between nib side surfaces. A tubular opening 42 extending outward from base 18 forward of the wicking chamber 24 provides a window for viewing the nibs 22, 34, 36 and the wicking process.

As will be understood by the skilled person, the relative angle of the central axis y-1 to central axes y-2 and y-3 should be small enough to allow a side surface of the donating nibs 34, 36 and not the tip of each nib alone to contact the wicking nib 22, but the angle should not be so small as to cause the side surfaces of the first and second marker nibs and the wicking nib to not contact each other by virtue of marker barrel interference. In some aspects, the wicking nib 22 is configured to receive proportionate amounts of each color of donating markers 30, 32 to provide a dual-color marker that can deposit one or more colors onto a marking surface. Thus, in preferred embodiments, donating markers 30, 32 are colored and the first marker 30 is a different color than the second marker 32. Alternatively, both markers 30, 32 can be the same color to produce a single-colored marker.

As described herein, the wicking nib device 10 may be used to quickly create a nib 22 that is customized with two or more different colored inks. After saturation with the two different inks from two different markers 30, 32, the wicking nib 22 can be used to mark with a first color from one portion of the nib (generally corresponding to the color of the first marker 30), a second color different from another portion of the nib (generally corresponding to the color of the second marker 32), or a dual-colored marking from a combined portion of the nib 22, typically located at or near a central point or tip end of the nib (for example, on or near the point or tip of the marker nib when a broad line marker is used), where both ink colors are transferred onto the marking surface. In some aspects, the marker boundary between the two wicked inks may begin to blend colors, creating a third color between the adjacent, saturated zones of the wicking nib. In further aspects, over time, the wicking nib may combine greater and greater concentrations of the adjacent ink colors at a boundary near an approximate midpoint between the two, absorbed colors.

With reference again to FIGS. 1*a*-1*c*, the exemplary wicking nib device 10 comprises a tubular shaped central wicking-nib positioner 12 configured to orient a central wicking nib 22 between a pair of donating marker nibs 34, 36 from first and second color markers 30, 32. The barrels 38, 40 of the first and second color markers are secured in place by marker holders 14, 16. In some aspects, the central wicking nib positioner 12 is configured to secure a colorless wicking nib 22, while in other aspects, the central wicking nib positioner 12 is configured to secure a wicking marker barrel 28 that retains the colorless wicking nib 22, to provide a wicking marker 20. The wicking marker barrel 28 containing wicking nib 22, or wicking nib 22 alone, as appropriate, may be secured within the central wicking nib positioner 12 at a particular orientation with respect to the adjacent marker holders 14, 16 and at a particular angle (for example, at least about 30 degrees, at least about 45 degrees, or from about 30 degrees to about 80 degrees) with reference to the wicking nib 22 to facilitate fluid transfer from surface-contacting nib structures 34, 36 of the first and second markers 30, 32 to wicking nib 22.

As described above, in preferred embodiments, a side surface of the nib 34 of the first marker 30 and a side surface of the nib 36 of the second marker 32 are each in contact with different side surfaces of wicking nib 22. In further aspects, the central wicking nib positioner 12 orients a wicking nib marker housing or barrel 28 with the colorless wicking nib 22 exiting the bottom opening of the central wicking nib positioner 12. Simultaneously, the first ink-donating marker 30 may be positioned in the first marker holder 14 such that the ink-donating nib 30 of the first marker 30 exits an opening at the bottom of the first marker holder 14, with at least a portion of the first ink-donating nib surface seated directly adjacent and/or in abutting contact with a surface of the colorless wicking nib 22 (e.g. a portion of the right side surface of the nib 34 of the first marker 30 in contact with a portion of the left side surface of the wicking nib 22), and the second ink-donating marker 32 may be positioned in the second marker holder 16, with at least a portion of the second ink-donating nib surface seated directly adjacent and/or in abutting contact with a surface of the colorless wicking nib 22 (e.g. a portion of the left side surface of the nib 36 of the second marker 32 in contact with a portion of the right side surface of the wicking nib 22).

As used herein, the side surface of a nib will be understood to mean a surface of the nib extending from the tip of the nib upward a distance toward the base of the nib. The tip of a nib will be understood to be the vertex or center peak point of the angled sides of the marker nib in situations where a conical marker is used. For non-conical markers, the tip is understood to be the free end of the nib when inserted into a marker barrel. The base of the nib is the end of the nib opposite the tip and adjacent the marker barrel when inserted into a marker barrel. In some embodiments such as the exemplary embodiment shown in FIGS. 1*a*-1*c*, the first ink-donating nib 34 and the second ink-donating nib 34 are conically shaped and are oriented on opposing sides of the central wicking nib 22.

Figure 2:
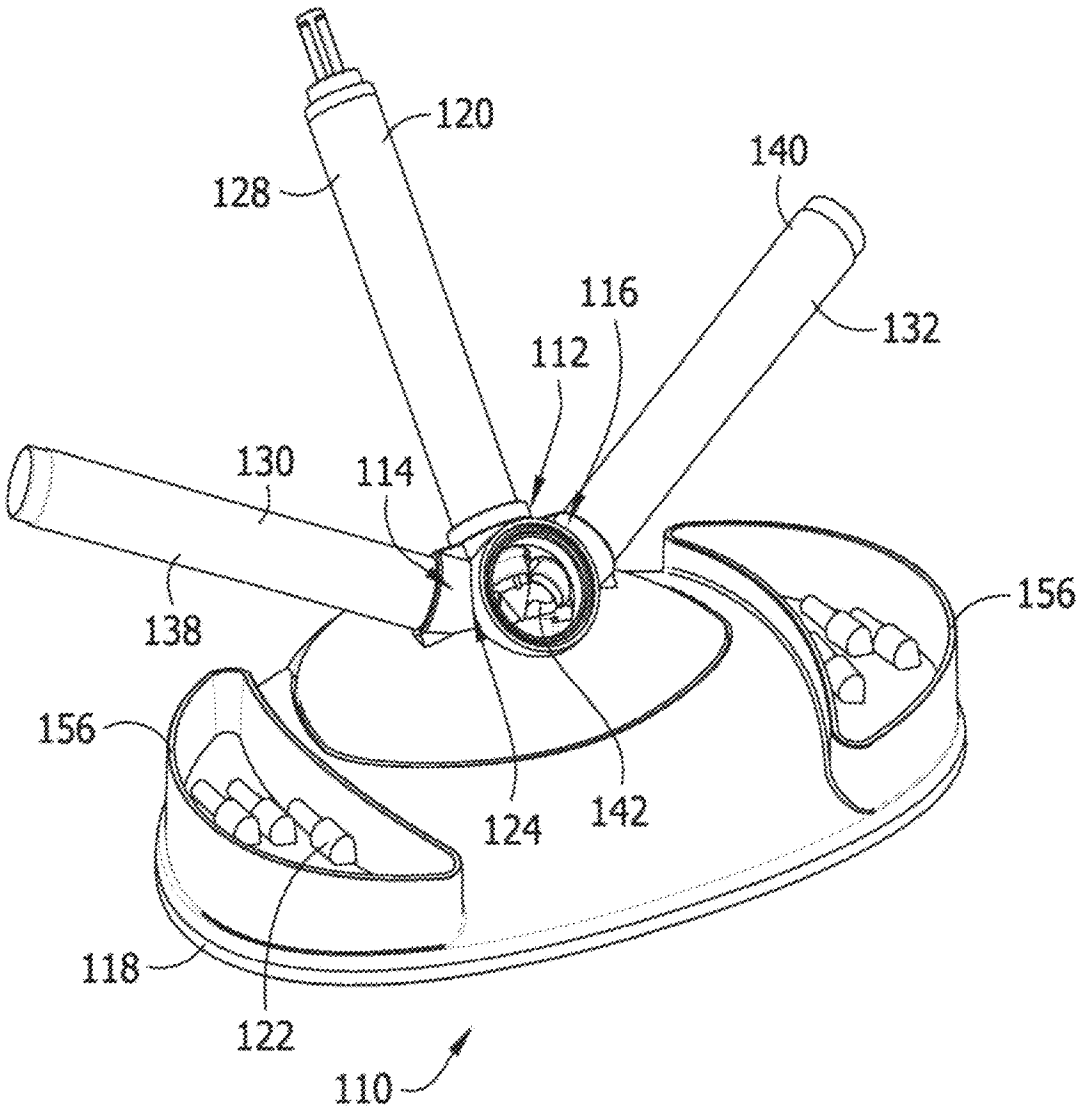
FIG. 2 is a perspective view of a wicking nib device in accordance with a second exemplary embodiment wherein a wicking marker having a wicking nib and two colored markers each having donating nibs are positioned within the wicking nib device.
Figure 3:
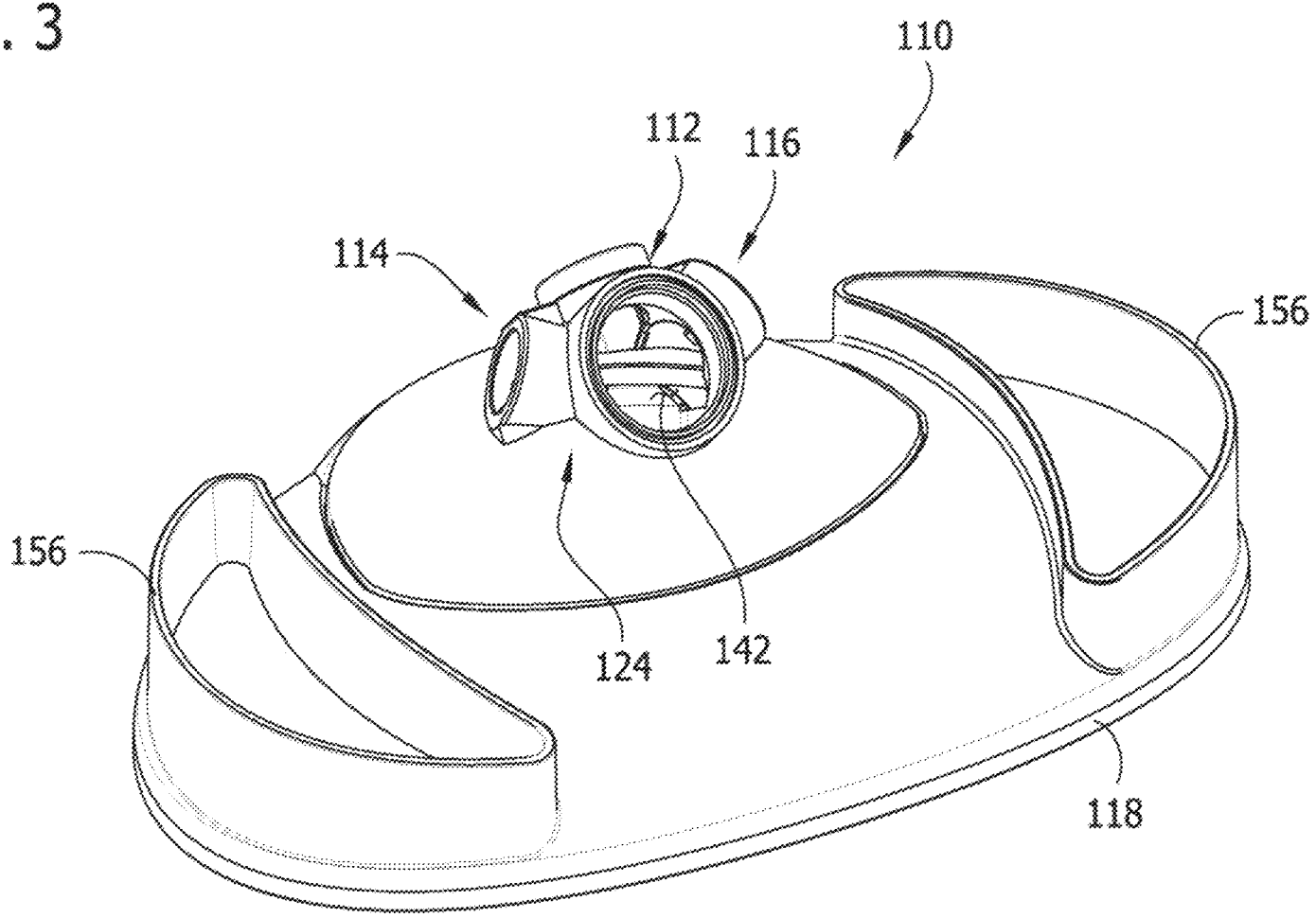
FIG. 3 is a perspective view of the wicking nib device of FIG. 2 without the wicking marker and the colored markers.
Figure 4:
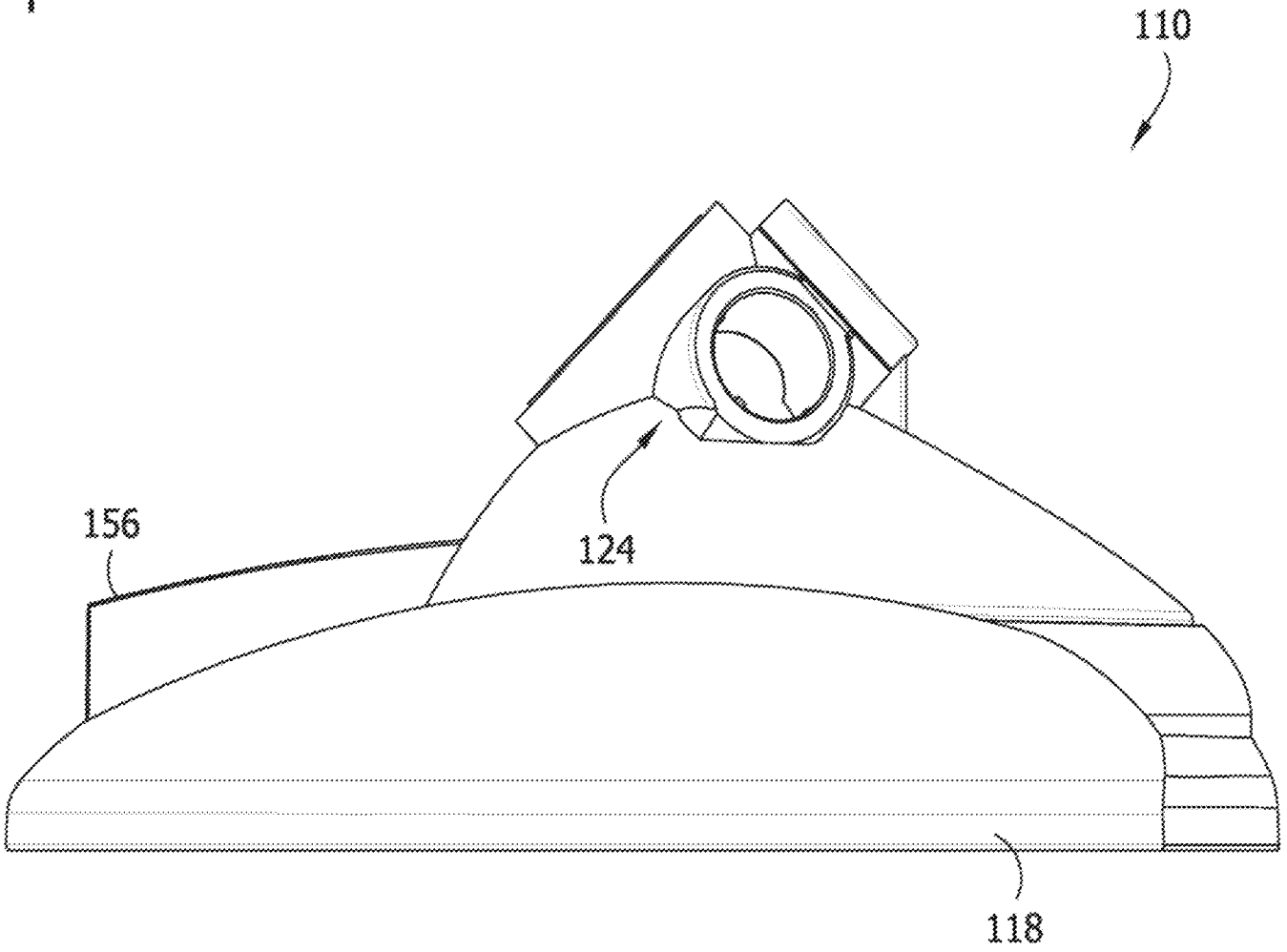
FIG. 4 is a side view of the wicking nib device of FIG. 3 with a holding tray removed.
Figure 5:
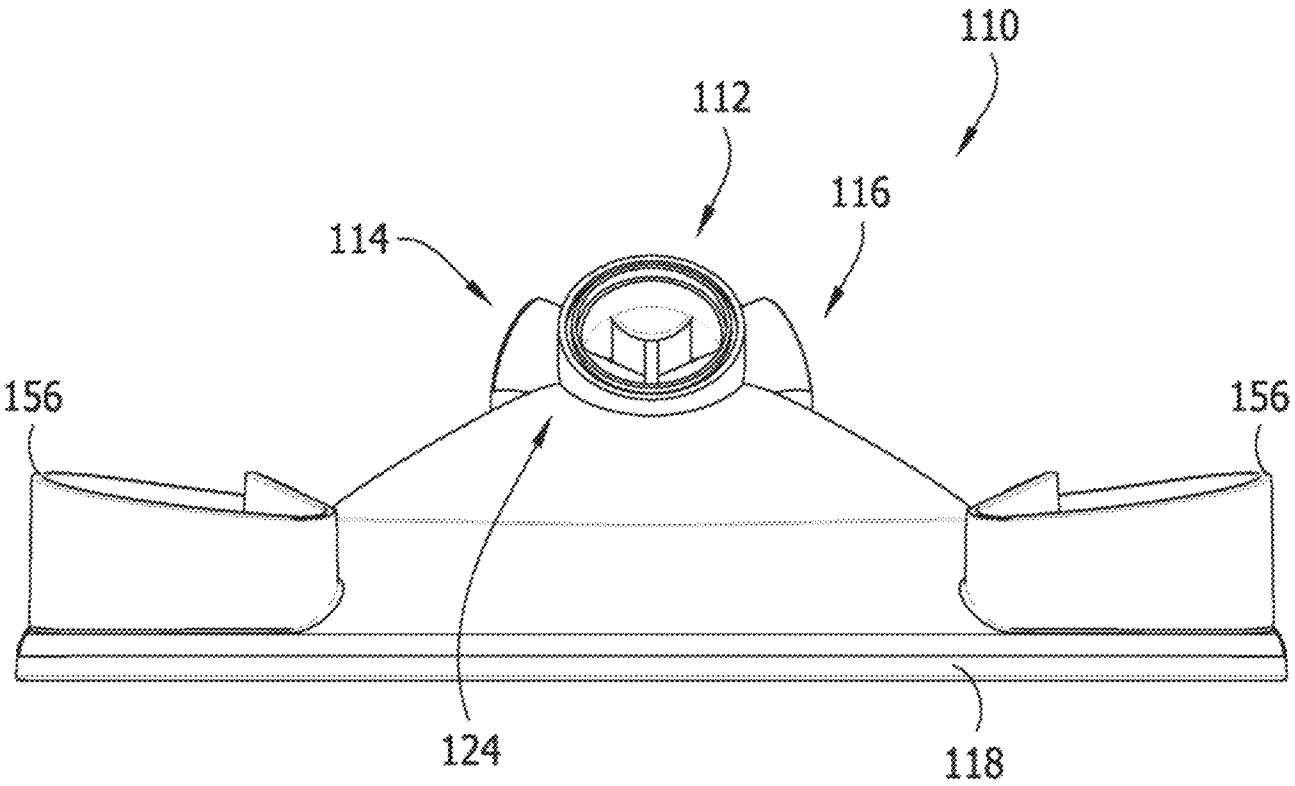
FIG. 5 is a front view of the wicking nib device of FIG. 3.

FIG. 2 illustrates another exemplary embodiment of a wicking nib device 110 according to the present disclosure. The device 110 is similar to device 10 described above, and corresponding parts are indicated by corresponding reference numbers plus 100. In this embodiment, the wicking nib device 110 comprises a wicking nib positioner 112, a pair of mirrored marker positioners 114, 116, a viewing aperture 142, and storage compartments 156 configured to receive a plurality of wicking nibs 122 for use within the wicking nib positioner 112. In some aspects, the base unit housing 118 may include additional features configured to facilitate the fluid transfer from ink-donating markers 130, 132 to an ink-receiving wicking nib 122, such as washing component configured to clean the wicking nibs after use, or an ink-donating holder for orienting alternative ink-donating sources, such as a bottle or tube of fluid ink.

Figure 6:
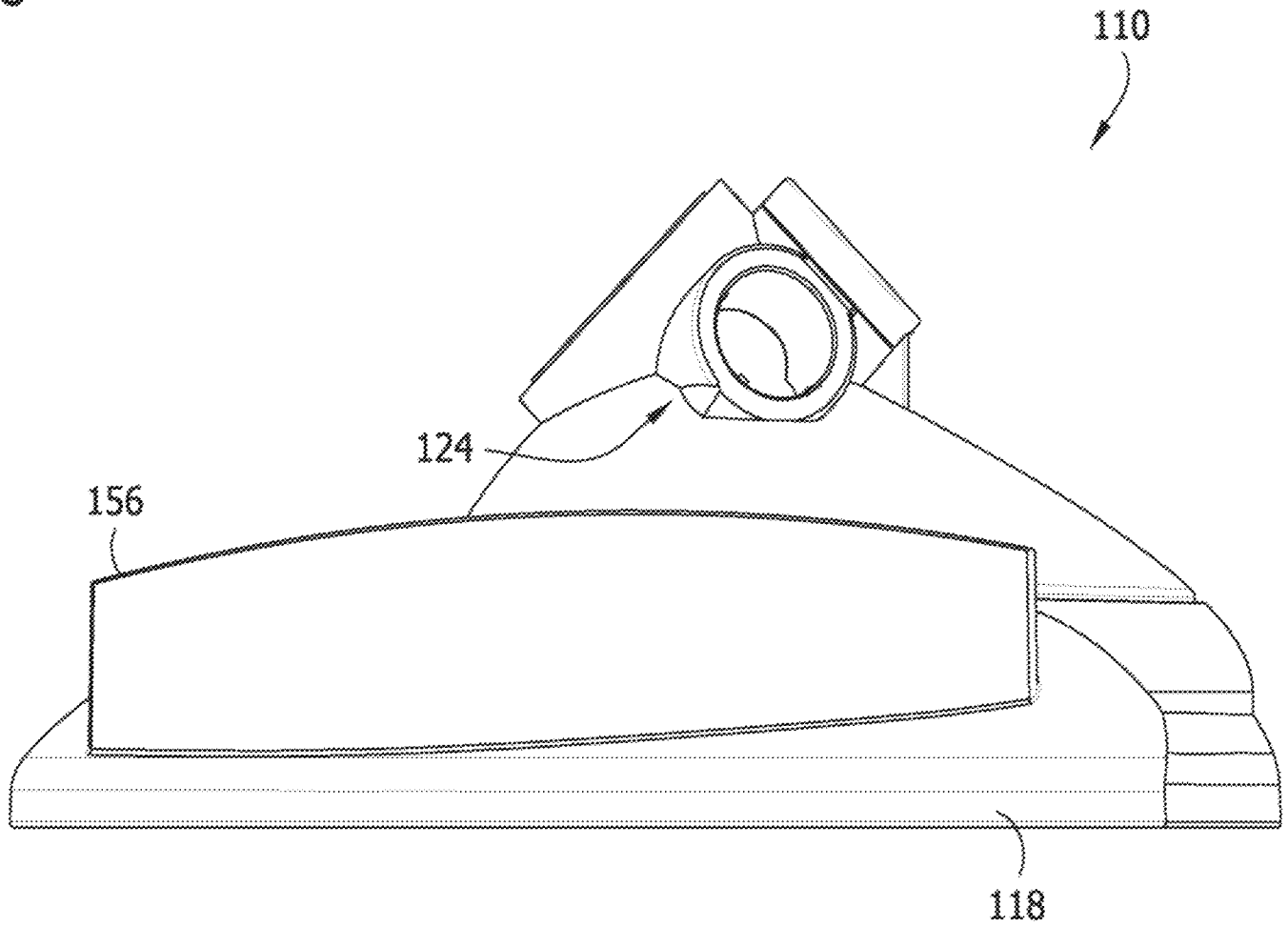
FIG. 6 is a side view of the wicking nib device of FIG. 3 with the holding tray in place.
Figure 7:
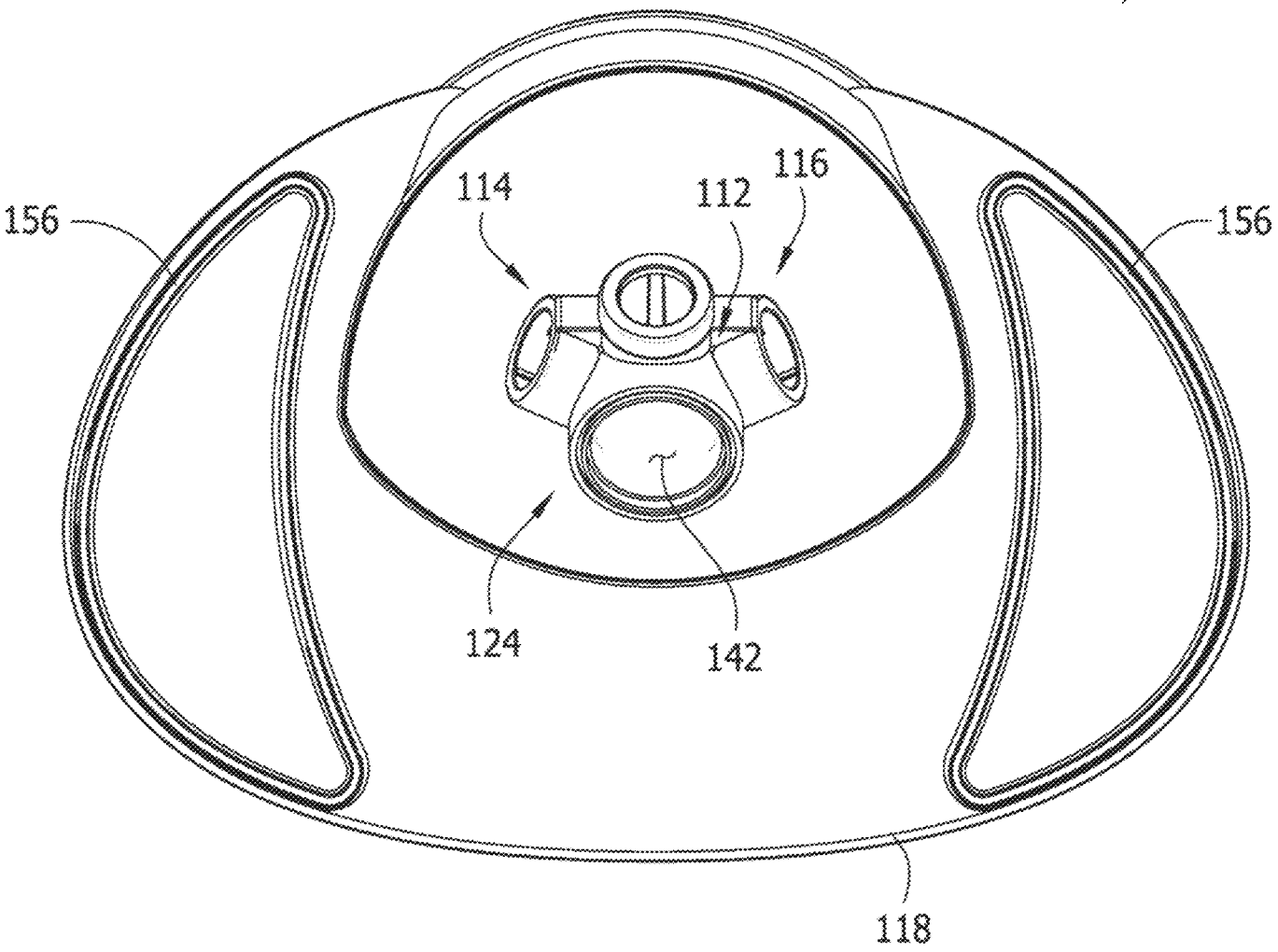
FIG. 7 is a top view of the wicking nib device of FIG. 3.

As shown in the multiple views of the exemplary wicking nib device 110 in FIGS. 3-7, the wicking nib positioner 112 may be generally upright, though not strictly vertical. For example, as best shown in FIG. 6, positioner 112 extends rearward at a slight angle rearward from base 118 such that it is not aligned or parallel the central vertical axis y-4 of base 118. In certain embodiments, positioner 112 is positioned at a slight angle from about 20 degrees to about 30 degrees from the vertical axis y-4 of base 118, providing a reference orientation of the wicking nib surface around which the mirrored marker positioners 136, 140 are configured to join the ink-donating nibs of markers 130, 132. Accordingly, in some aspects, the marker positioners 114, 116 are angled toward the axis of the wicking nib positioner 112 to provide optimal transfer of ink between the contacting nib structures of markers 130, 134 as well as optimal viewing of the ink-absorbing process through the base unit aperture 152. For example, in some aspects, the vertical axis y-2 of the first marker positioner 114 is from about 50 degrees to about 60 degrees from the vertical axis y-1 of wicking nib positioner 112, and the vertical axis y-3 of the second marker positioner 116 is from about 50 degrees to about 60 degrees from the vertical axis y-1 of the wicking nib positioner 112. The angles of the marker positioners 114, 116 relative to the wicking nib positioner 112 allows the nibs of markers placed in the marker positioners 114, 116 the largest contact patch with wicking nib 122, thereby creating maximum wicking ability.

Figure 8:
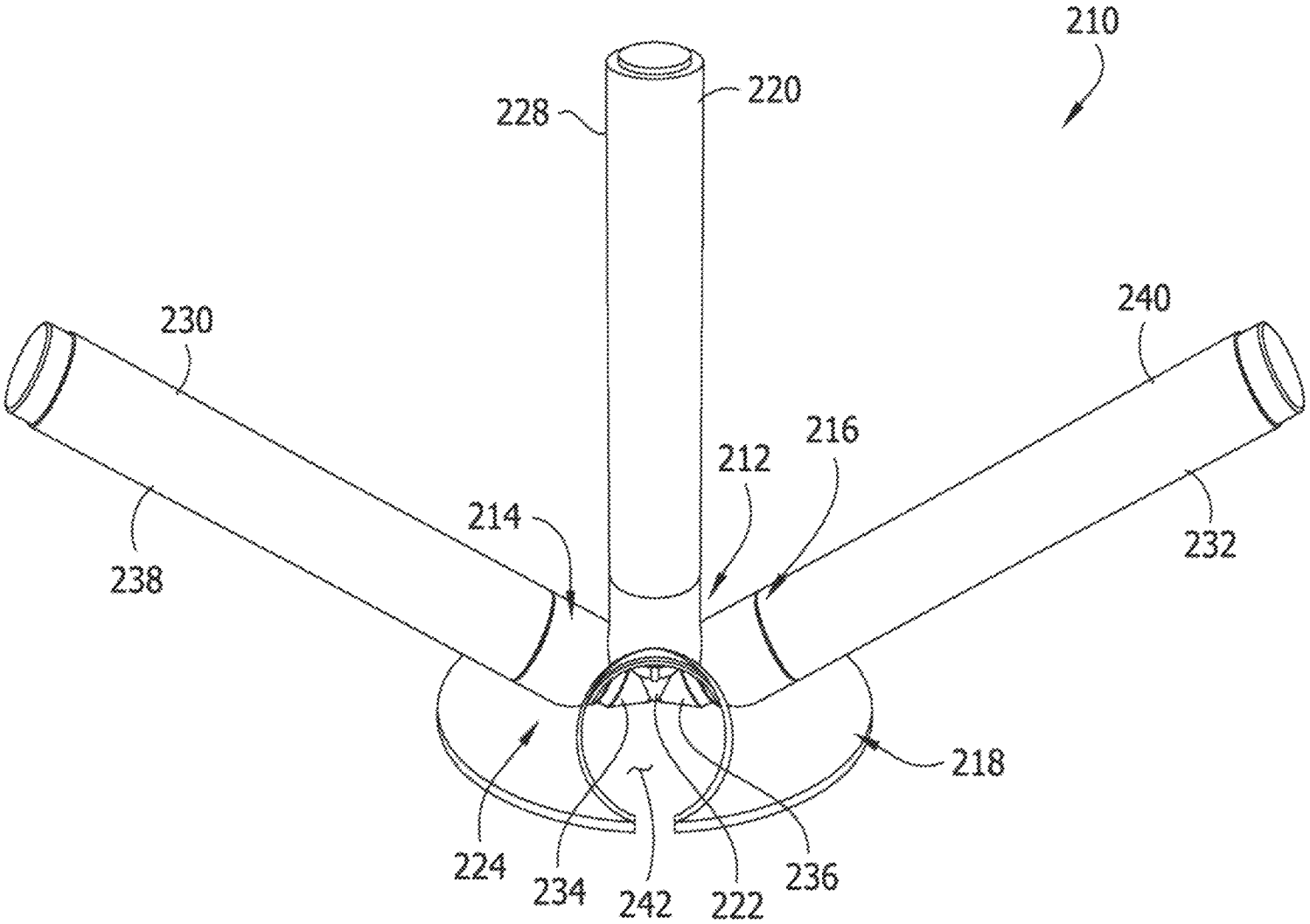
FIG. 8 is a perspective view of a wicking nib device in accordance with a third exemplary embodiment wherein a wicking marker having a wicking nib and two colored markers are positioned within the wicking nib device.
Figure 9:
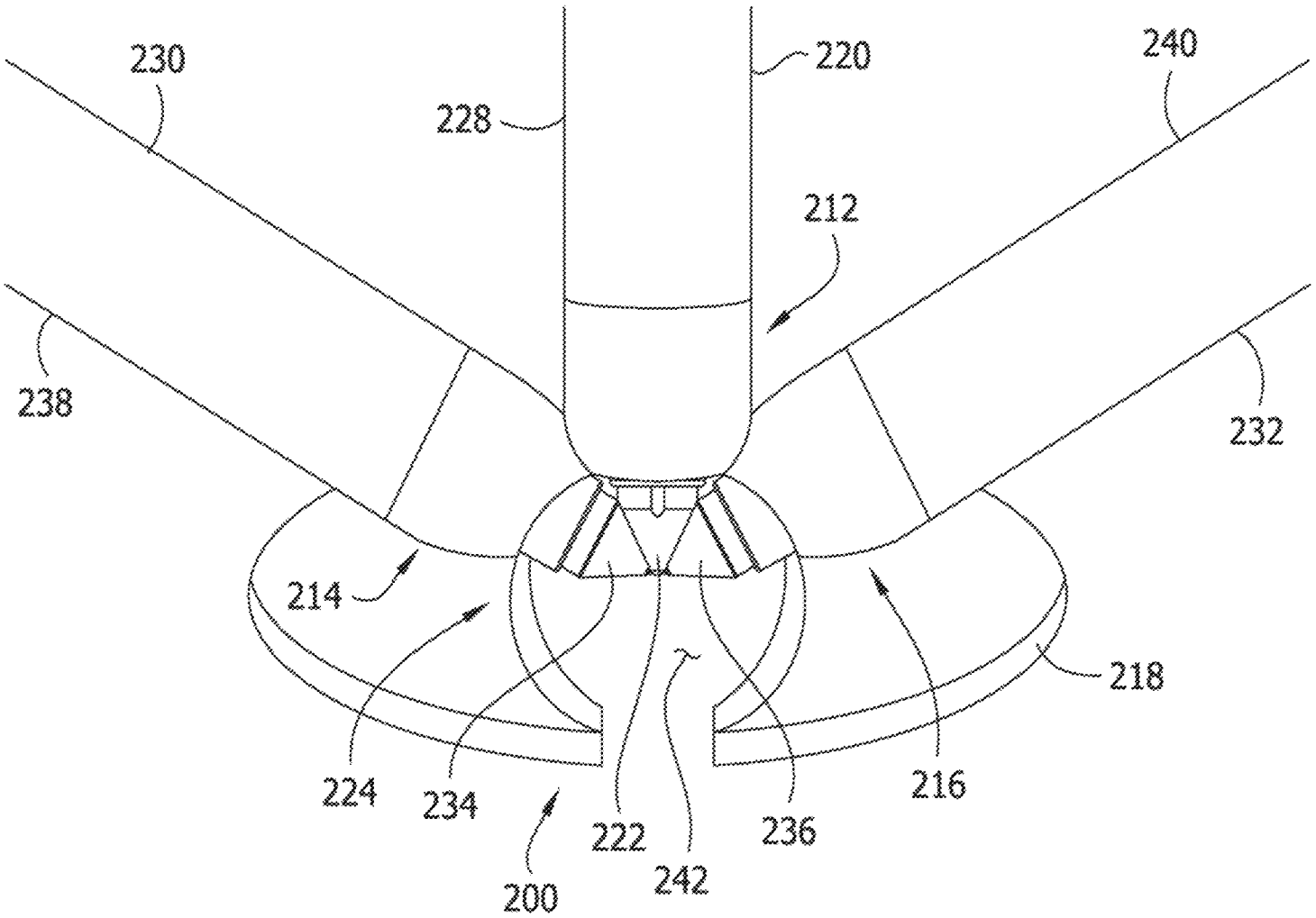
FIG. 9 is a magnified perspective view of the wicking nib device of FIG. 8

FIGS. 8-9 illustrate another exemplary embodiment of a wicking nib device 210 according to the present disclosure. The device 210 is similar to the device 10 described above, and corresponding parts are indicated by corresponding reference numbers plus 200. Device 210 has a simplified base housing 218 containing mirrored positioning chambers 214, 216 oriented to engage the angled side surfaces of donating nibs 234, 236 of two ink-donating markers 230, 232 with opposing angled absorbent side surfaces of wicking nib 222.

In some embodiments, such as shown in FIG. 9, the wicking nib 222 itself may be any shape configured to contact the intersecting ink-donating marker nibs 234, 236, such as a rounded, bullet nib, or an angled conical nib structure, such as a conical marking nib structure having a pore size between approximately 20 to 40 micrometers, and having a porosity between approximately 40% to 70%. In yet another embodiment, the wicking nib structure 222 may include a semi-rigid, porous plastic nib, such as a conical broadline marker nib, comprising a pore size of approximately 30 microns and having approximately 64% pore volume. In another embodiment, a conical sintered plastic nib of the wicking nib structure may include a pore size of approximately 40 microns, with an approximately 67% pore volume. In further aspects, the wicking nib structure may be a shaped stamping structure configured to absorb the donated ink from the inserted markers, while creating a stamping surface with a plurality of absorbed ink colors.

Although depicted in various embodiments including two donor-marker colors, in further aspects, a plurality of ink-donating markers may be secured within the base unit housing for simultaneous ink transfer to the wicking nib. Accordingly, some wicking nib device base units may include two or more ink-donating marker holders, such that a completed wicking marker includes two or more transferred colors. In one aspect, the number of donor markers contacting the wicking nib corresponds to the size of the wicking nib and the desired coloring pattern. In further aspects, the plurality of donating marker nibs may be arranged in a distributed manner to evenly apply ink to the surface of the wicking nib, such as two ink-donating nibs 234, 236 positioned against opposite sides of the wicking nib 222 (shown in FIG. 9), three ink-donating nibs positioned against equivalent thirds of a recipient wicking nib, and in further aspects, four ink-donating nibs positioned at equally spaced quadrants of the wicking nib. In further aspects, based on the type of ink donated to the wicking nib structure, a variety of marking outcomes may result from the absorbed, wicking nib transferring absorbed ink onto a marking structure. For example, a plurality of ink-donating marker nibs may include oil-based inks, while in other embodiments, the ink-donating marker nibs may include water-based inks. In further aspects, the ink provided by the plurality of donating markers may include pH-sensitive, color-changing markers. As such, the resulting multi-color marking nib may generate a first pair of colored markings that may optionally be changed to a secondary color upon transfer from the wicking nib and transition using a developing marking solution. The combinations available, as a result of two absorbed inks within the wicking nib, may result, in some embodiments, in the coloring laydown and blending of two colors, and the coloring and blending of two transitioned colors.

Also provided herein is a method of wicking a donor solution (e.g., ink) into a wicking nib. The method generally comprises inserting a wicking nib (optionally in a wicking nib marker barrel) into a wicking nib positioner that positions a side surface of the wicking nib directly adjacent and/or in abutting contact with a color donor. In some embodiments, the wicking nib positioner positions a first side surface of the wicking nib directly adjacent and/or in abutting contact with a first color donor, and positions a second side surface of the wicking nib directly adjacent and/or in abutting contact with a second color donor. In some embodiments, the color donor(s) may be colored markers having colored nibs. In some embodiments, a method of wicking two donor solutions onto different areas of a wicking nib comprises inserting a first donor marker and a second donor marker into first and second positioning chambers, respectively. As described above, the first and second positioning chambers should be angled relative to a wicking nib to allow contact between side surfaces of the first marker nib and wicking nib and the second marker nib and wicking nib. After a duration of time has passed sufficient to allow saturation of the wicking nib, the wicking nib can be removed and used for writing or drawing. In circumstances where a wicking nib without a wicking nib marker barrel was used, the wicking nib can be placed in a marker barrel to assist with writing and drawing.

Figure 10A:
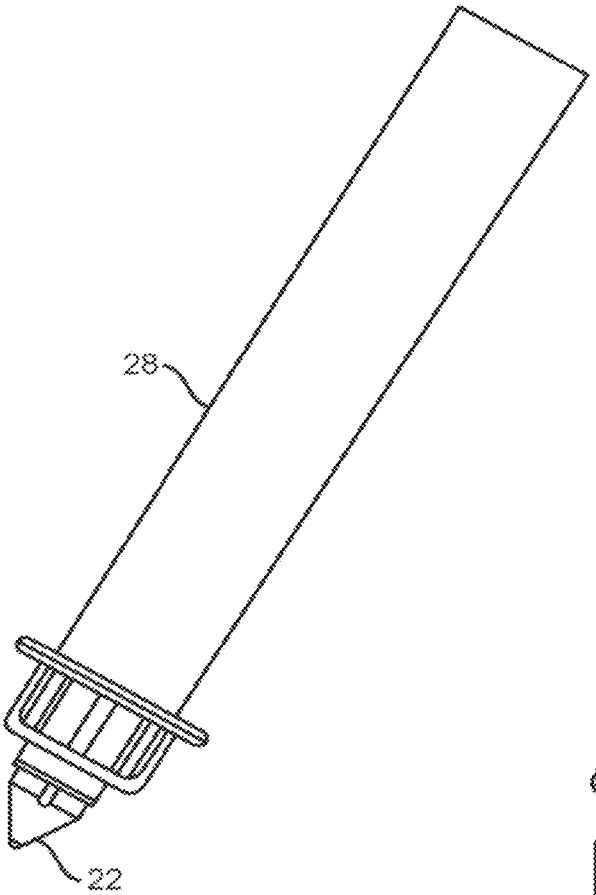
FIG. 10*a* is a perspective view of wicking marker in accordance with an exemplary embodiment.
Figure 10B:
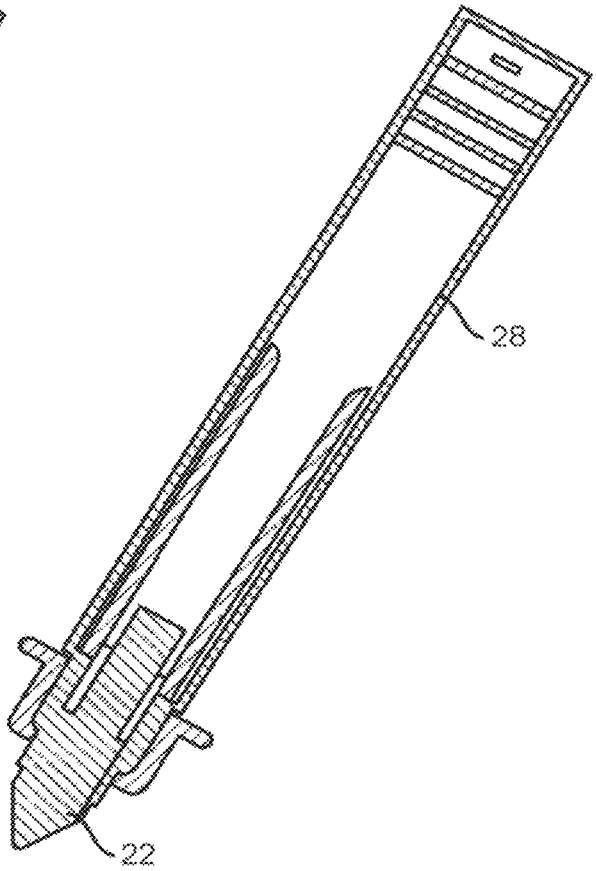
FIG. 10*b* is a cross-sectional view of the wicking marker of FIG. 10*a;*
Figure 11B:
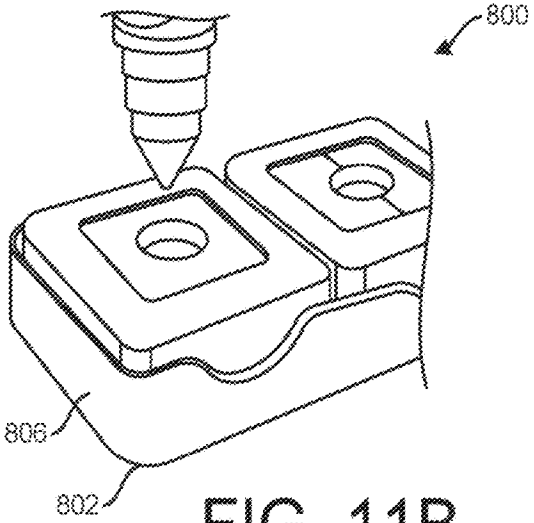
FIG. 11*b* is a magnified perspective view of a portion of the wicking nib system or kit of FIG. 11*a* depicting a wicking nib marker positioned to be inserted into one of the interchangeable, dual-ink wicking nib devices.
Figure 11D:
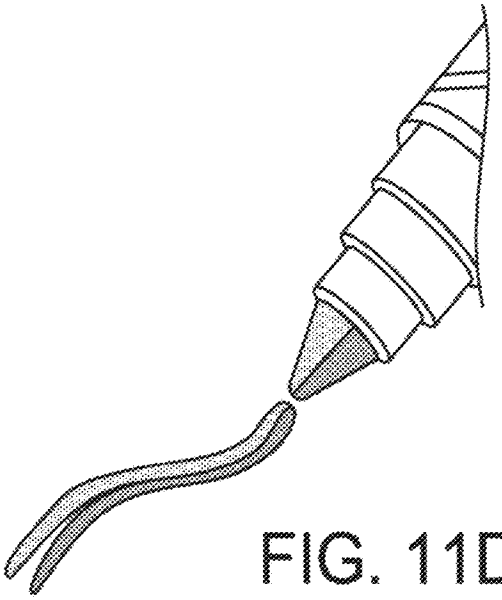
FIG. 11*d* is a perspective view of the wicking nib end of the wicking marker depicted in FIG. 11*c* showing the dual color markings that can be made with the wicking marker.
Figure 11A:
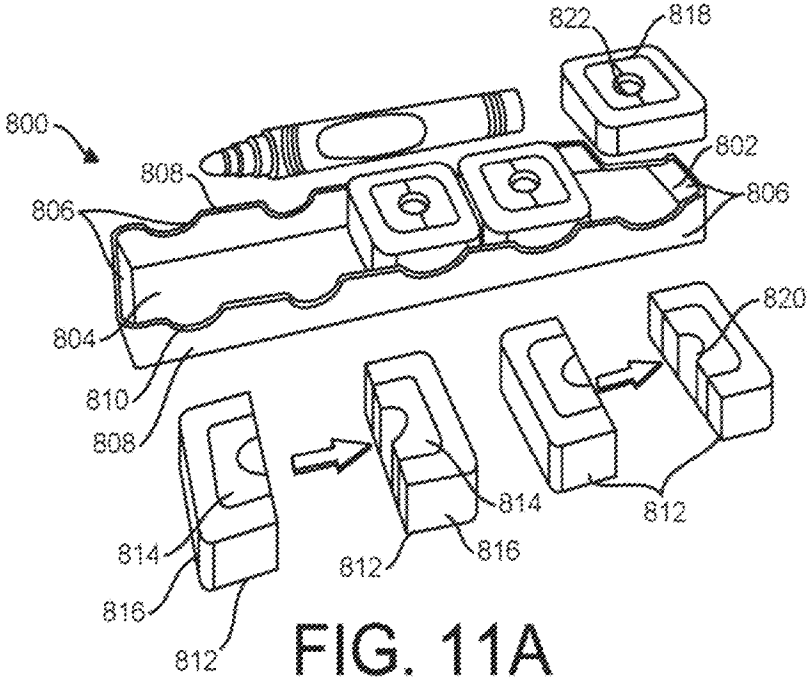
FIG. 11*a* depicts a wicking nib system or kit comprising a plurality of interchangeable, dual-ink wicking nib devices in accordance with a fourth exemplary embodiment.
Figure 11C:
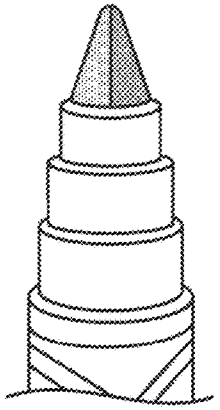
FIG. 11*c* is a magnified side view of the wicking nib end of the wicking marker depicted in FIG. 11*b* after it has been inserted into the interchangeable, dual-ink wicking nib device.
Figure 12B:
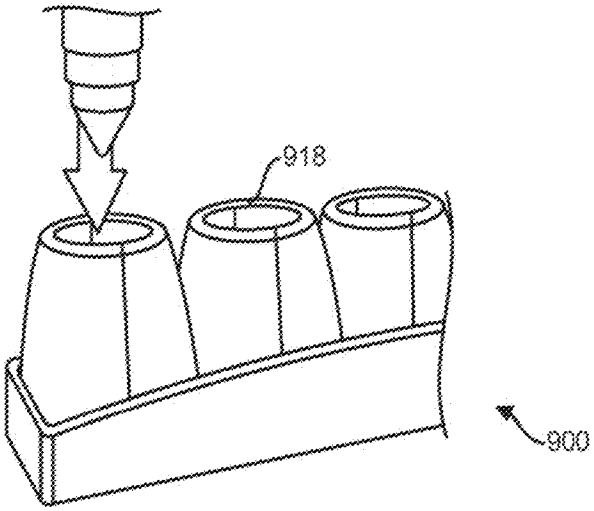
FIG. 12*b* is a magnified perspective view of a portion of the wicking nib system or kit of FIG. 12*a* depicting a wicking marker positioned to be inserted into one of the interchangeable, dual-ink wicking nib devices.
Figure 12D:
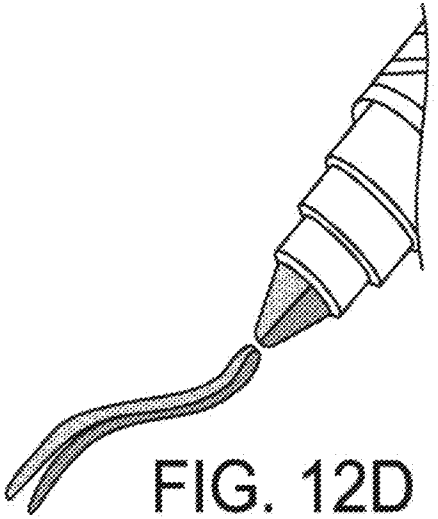
FIG. 12*d* is a perspective view of the wicking nib end of the wicking marker depicted in FIG. 12*c* showing the dual color markings that can be made with the wicking marker.
Figure 12A:
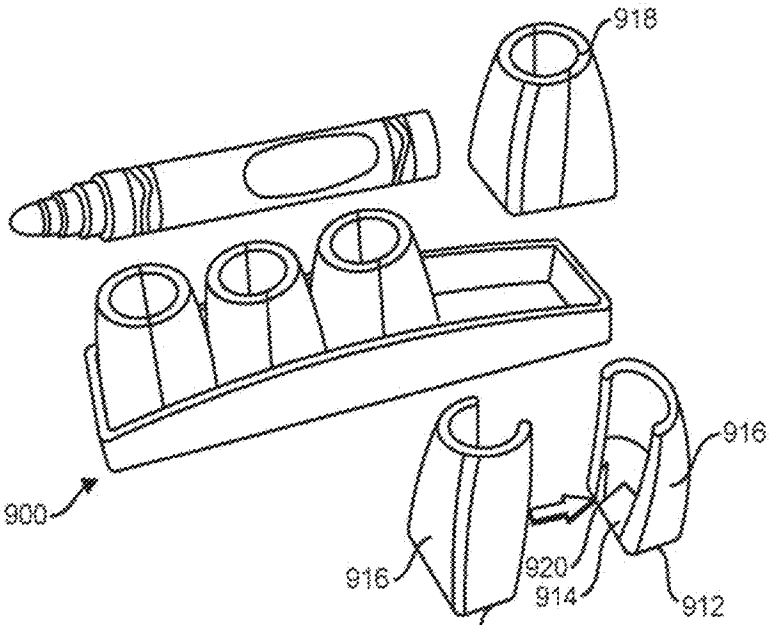
FIG. 12*a* depicts wicking nib system or kit comprising a plurality of interchangeable, dual-ink wicking nib devices in accordance with a fifth exemplary embodiment.
Figure 12C:
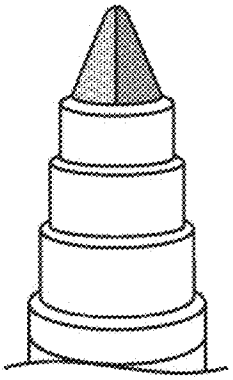
FIG. 12*c* is a magnified side view of the wicking nib end of the wicking marker depicted in FIG. 12*b* after it has been inserted into the interchangeable, dual-ink wicking nib device.

FIG. 10*a* depicts an exemplary wicking nib housing or barrel 28, from an external, side view, and FIG. 10*b* depicts the wicking nib housing 28 from a cross-sectional view, both with a wicking nib 22 partially imbedded within the housing 28, and partially with the nib tip exposed out of the lower end. In some aspects, the wicking nib housing 28 may be any shape configured to be manipulated by a user, such as a wide-barrel wicking nib housing that can secure multiple different sizes of recipient wicking nib structures. As shown in the cross-sectional view in FIG. 10*b*, the wicking nib 22 is configured to operate in a reservoir-less system, without a separate ink-donating source inside the wicking nib housing 28, for marking with the bi-color, wicked ink absorbed from the tip surface of the wicking nib.

Turning next to FIGS. 11-19, other exemplary wicking nib devices for positioning one or more side portions of a wicking nib in contact with one or more color donors to provide a multi-color nib are shown.

FIGS. 11*a*-11*d* illustrates a system or kit for making dual-colored markers comprising an ink donating station 800. This system includes a base tray 802 that is generally rectangular in shape. The tray 802 has a bottom wall 804 and four side walls 806. The two longitudinal side walls 808 can include cut-outs 810 to allow the user ease of access to the ink pads 812 stored therein. Each ink pad 812 includes a central absorbent section 814 for retaining colored ink and a housing 816 surrounding the absorbent section 814 on all sides except the top surface and inner side edge of the absorbent section 814. Each ink pad 812 is configured to be removably and interchangeably joined with another ink pad 812 to form an ink pad composite 818 with the inner side edges of each absorbent section 814 in abutting engagement. The ink pads 814 can be joined by any means known in the art such as by mating tabs and apertures along the inner side edges of the housing 816. The absorbent sections 814 of the composite 818 can include the same color of ink (to produce a single-colored nib) or can be different colors (to produce a dual-colored nib). Each absorbent section 814 has a conically shaped semi-circular well 820 along its inner side edge. When two ink pads 812 are joined to form an ink pad composite 818, wells 820 combine to form a positioning aperture 822 that is sized and shaped to snugly receive a nib of a marker with a majority of the sidewall of the nib extending from the tip end to a base of the nib in contact with the absorbent sections 814.

In practice, a user joins two ink pads 812 of his or her choosing together to form an ink pad composite 818. The ink pad composite 818 serves as a wicking nib device that can be placed in the tray 802 for ease of use or for storage purposes. Then, the user inserts a marker nib 824 into the aperture 822 of the ink pad composite 818 with half of the marker nib surface positioned in contact with the absorbent section 814 of one ink pad 812 and the other half of the marker nib surface positioned in contact with the absorbent section 814 of another ink pad 812. Over time, each side surface of the nib 824 wicks ink from the respective ink pads 812 to provide a saturated marker nib having dual-colored nib (or a single-colored nib if both ink pads are of the same color).

FIG. 12 depicts another exemplary system or kit for making dual-colored markers including an ink donating station generally indicated by reference numeral 900. Station 900 is similar to station 800 described above, and corresponding parts are indicated by corresponding reference numbers plus 100. In place of ink pads 812, station 900 utilizes ink collars 912. Each ink collar 912 as defined herein comprises a single half of an ink collar composite 918 that serves as a wicking nib device. The ink collars 912 can be joined by any means known in the art including via mating tabs and apertures to removably and interchangeably form a composite 918. Each ink collar 912 includes an ink pad 914 at a bottom portion thereof with side walls 916 extending above and around ink pad 914 to form a cone shaped semi-circular well 920 at the joining edge (i.e., the edge that will be joined to another ink collar). Wells 920 define a positioning aperture (not shown) through joining of semi-circular wells 920 at the center point of composite 918 when the ink pads 914 are joined that is sized and shaped to snugly receive a nib of a marker.

Figure 13:
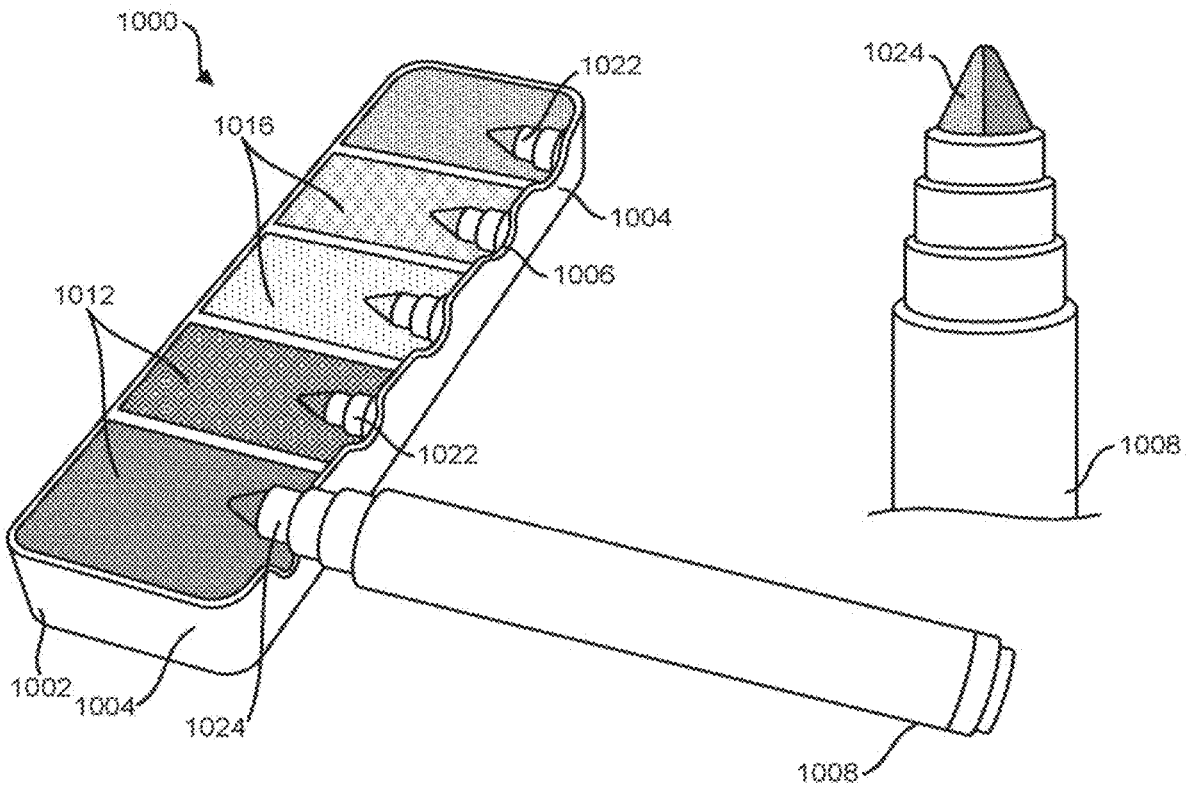
FIG. 13 is a perspective view of a wicking nib device in accordance with a sixth exemplary embodiment depicting a wicking marker positioned within one color depot of the wicking nib device and depicting a magnified side view of the wicking nib end of the wicking marker after positioning within two color depots.
Figure 14:
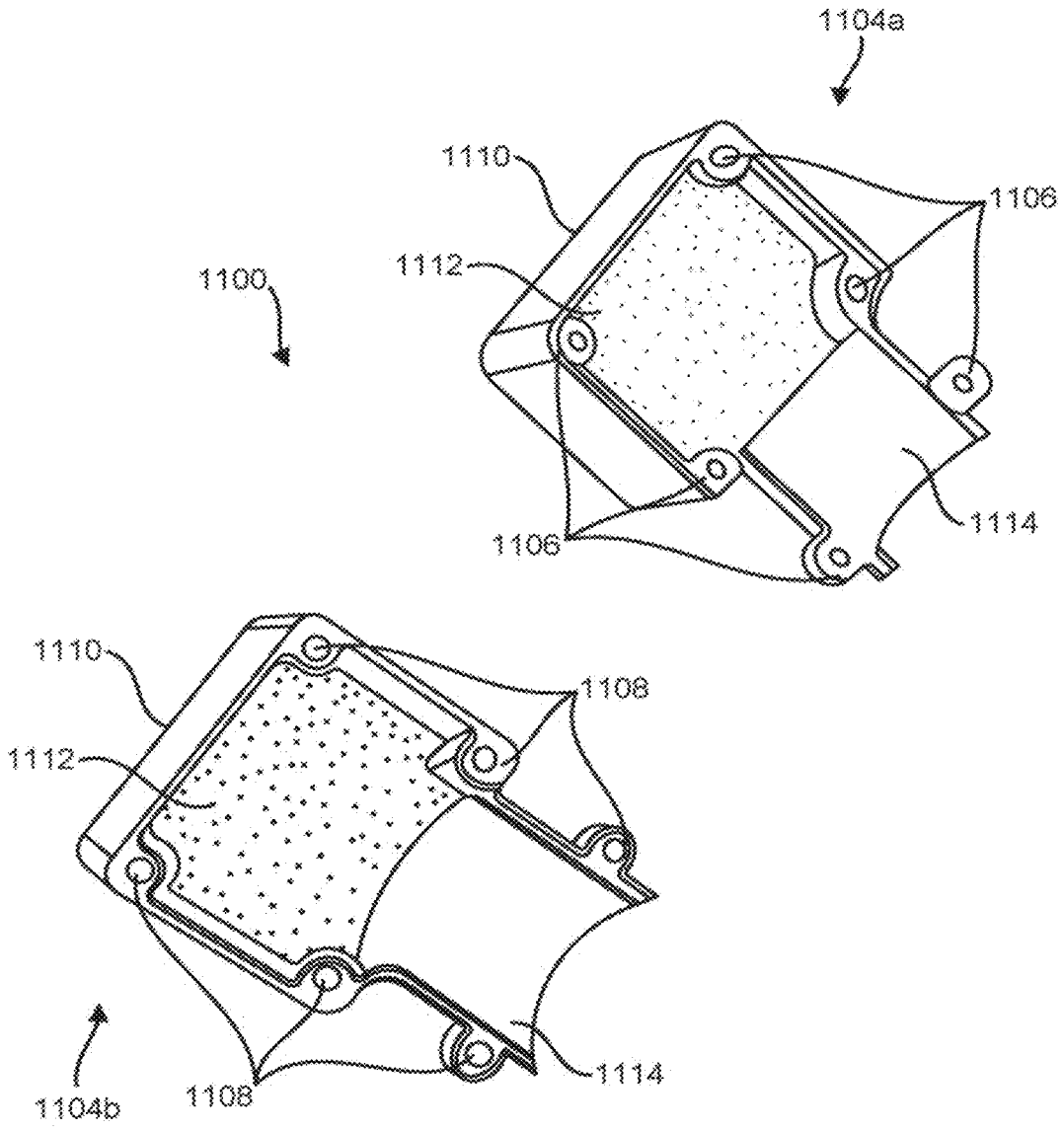
FIG. 14 is a perspective view of an interchangeable, dual-ink wicking nib device in accordance with a seventh exemplary embodiment depicting the two clamp sections of the wicking nib device separated with the internal surface of each clamp section facing upward.
Figure 15:
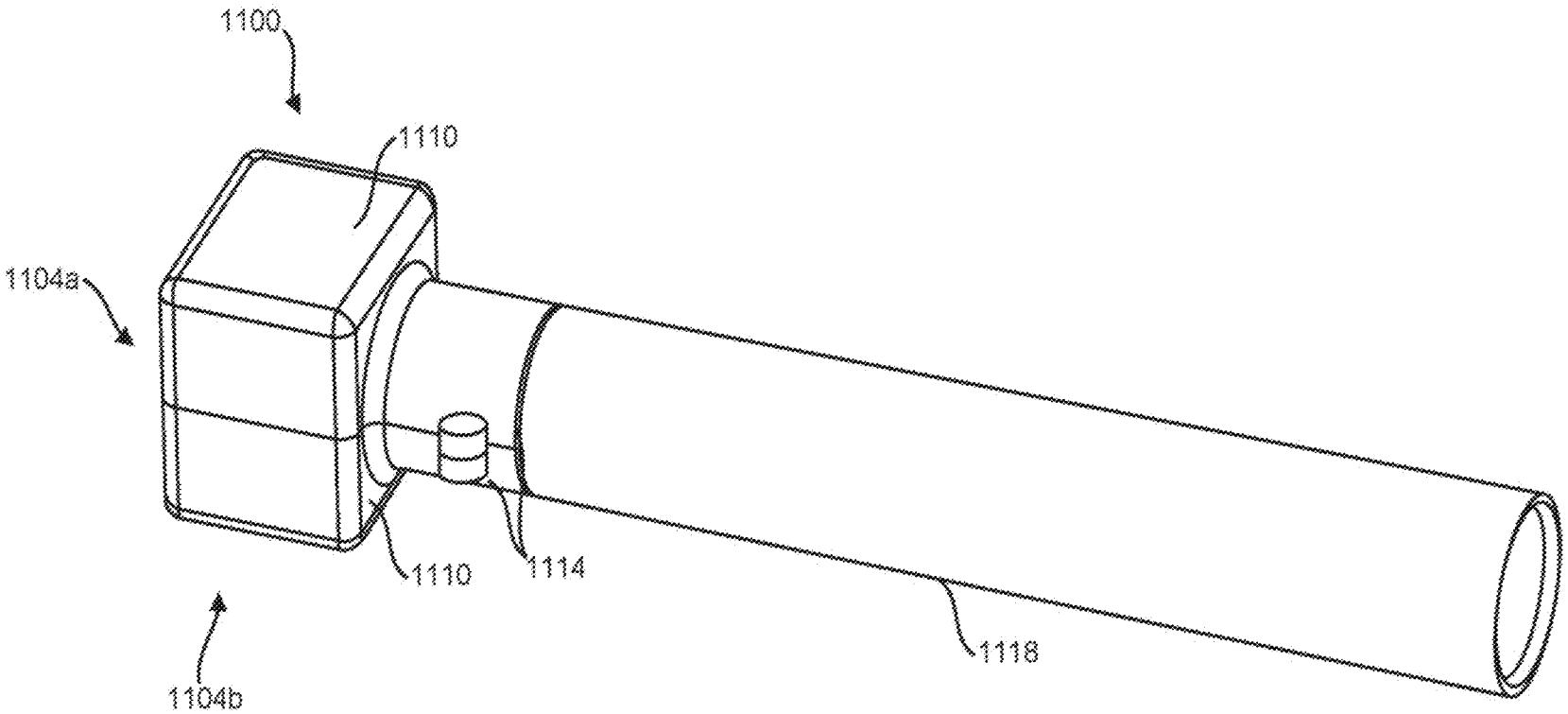
FIG. 15 is a perspective view of the interchangeable, dual-ink wicking nib device of FIG. 14 depicting the two clamp sections secured together with a wicking marker positioned within the wicking nib device between the two clamp sections.
Figure 16:
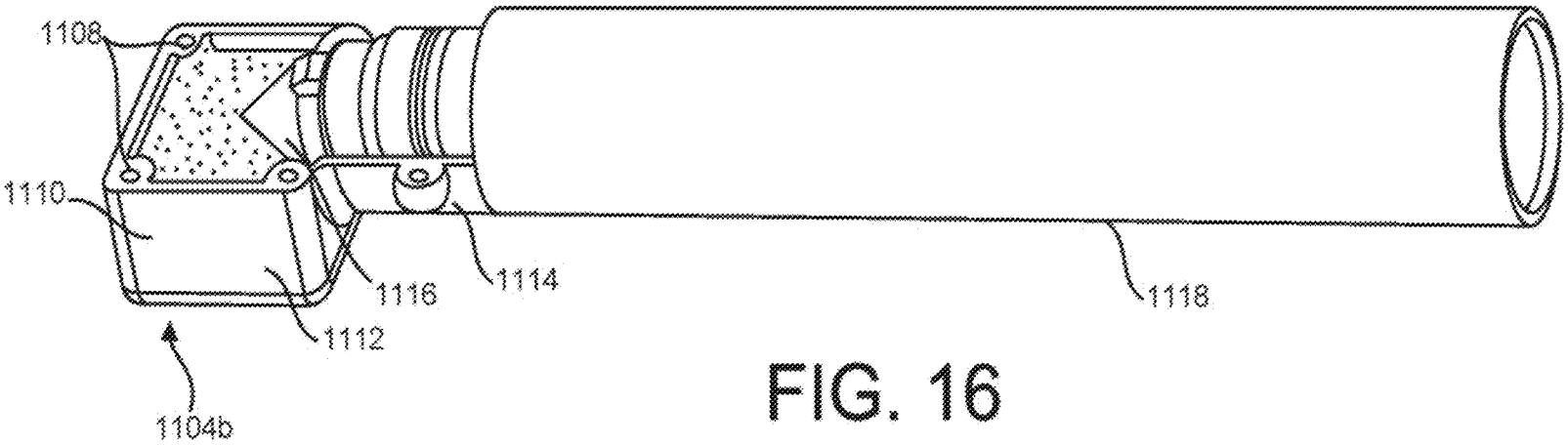
FIG. 16 is a cut-away view of FIG. 15 with one clamp section removed for purposes of illustrating the position of the wicking marker within the interchangeable, dual-ink wicking nib device of FIG. 14.
Figure 17:
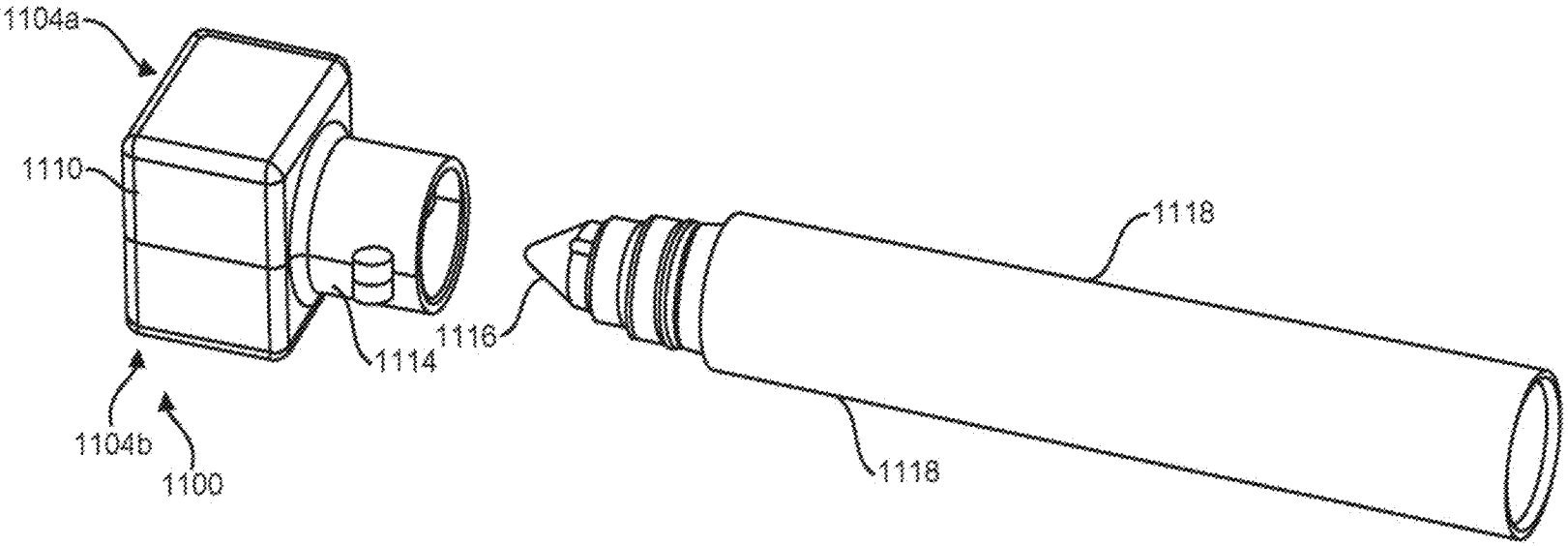
FIG. 17 is a perspective view of the wicking nib interchangeable, dual-ink wicking nib device of FIG. 14 depicting the two clamp sections secured together with a wicking marker positioned to be inserted into the wicking nib device.
Figure 18:
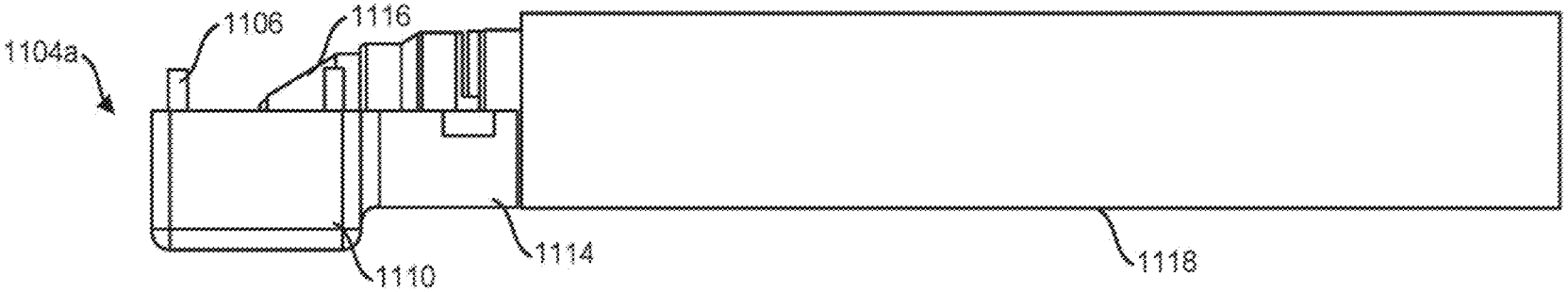
FIG. 18 is a side view of the cut-away view of FIG. 16.

FIG. 13 depicts another exemplary embodiment of an ink tip station generally indicated at 1000. The station 1000 includes a rectangular housing or tray 1002 having a bottom wall and side walls 1004. At least one side wall 1004 contains cut-outs 1006 sized and shaped to receive a barrel of a marker 1008. Tray 1002 houses a plurality of ink pads 1012. Each ink pad 1012 is separated from an adjacent ink pad 1012 by divider 1016. Directly adjacent to each cut-out 1006, each ink pad contains a conically shaped well 1022 sized and shaped to receive the nib 1024 of the marker 1008 a portion of the sidewall of the nib cradled in contact with the ink pad. In practice, a user places the nib 1024 of the marker 1008 in well 1022 and allows the nib 1020 to wick ink from ink pad 1012. If the user desires another color of ink at another section of marker 1008, the marker 1008 can be rotated and placed in another well 1022 of another ink pad 1010 and allowed to wick ink from that ink pad 1010. This process can be repeated to achieve any number of desired colors of marker nib.

FIGS. 14-18 depict an exemplary embodiment of an ink-donating collar that serves as a wicking nib device generally indicated at 1100. Collar 1100 is made of two clam-shell style halves 1104*a*, 1104*b* releasably coupled together via mating pins 1106 and apertures 1108. Each half 1104 includes a box shaped ink pad housing 1110 that retains an ink pad 1112 with a semi-circular trough or cradle 1114 extending outward from one side edge of the housing 1110 and ink pad 1112. When halves 1104*a*, 1104*b* are releasably secured together, cradles 1114 together define a cylindrical opening sized and shaped to receive a barrel of a marker 1118 with different portions of the sidewall of the nib in contact with the ink pad 1112 of each half 1104*a*, 1104*b*. The ink pad 1112 of each half 1104*a*, 1104*b* can be any desired color, and the ink pad color of one half 1104*a* can be different than the ink pad color of the other half 1104*b*.

Figure 19:
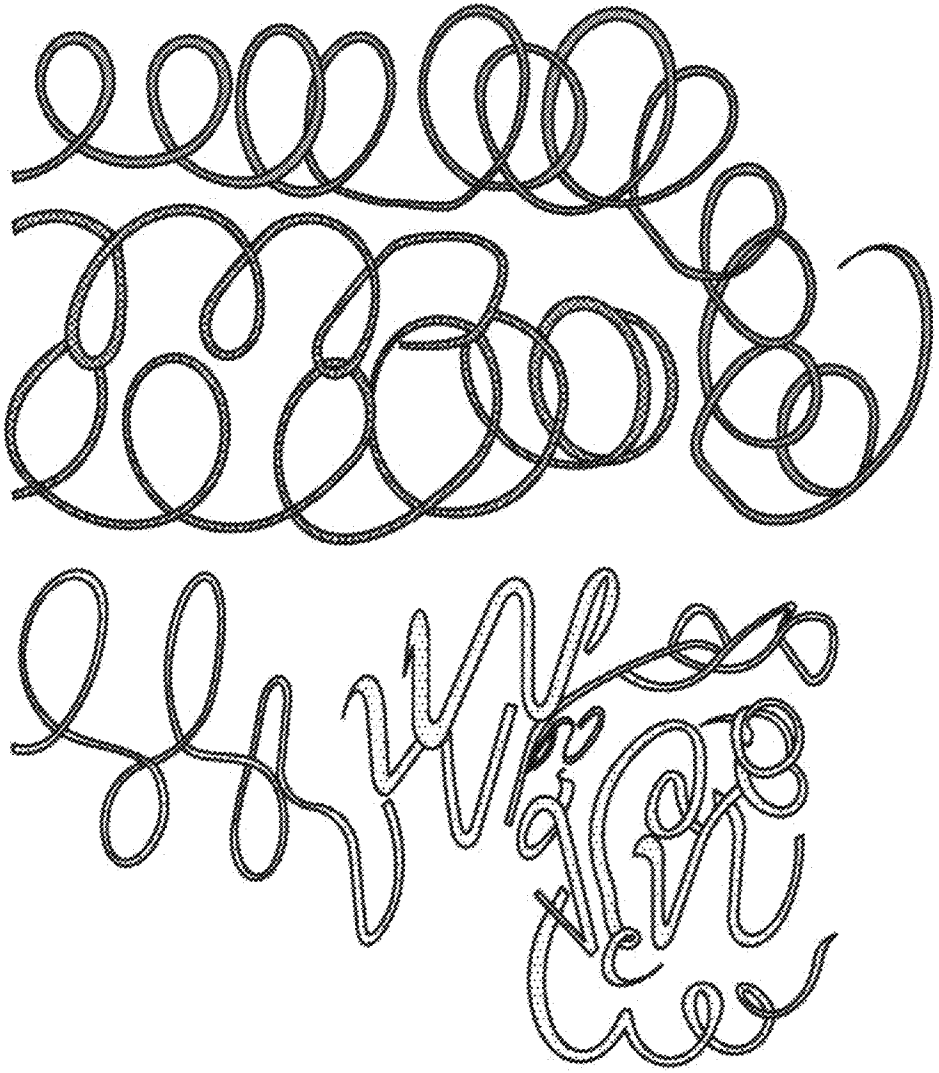
FIG. 19 is an image of ink drawings using a wicking marker that has been inserted into the dual-ink wicking nib device of FIG. 14, where different textures indicated different and/or dual colors.
Figure 20:
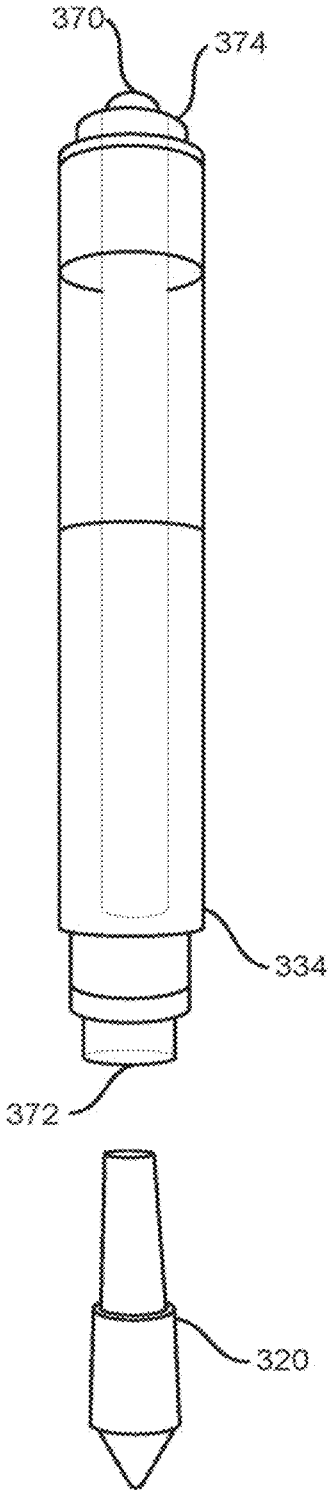
FIG. 20 is a side view of an interchangeable wicking nib marker depicting an absorbent wicking nib positioned to be inserted into the interchangeable wicking nib marker.
Figure 21:
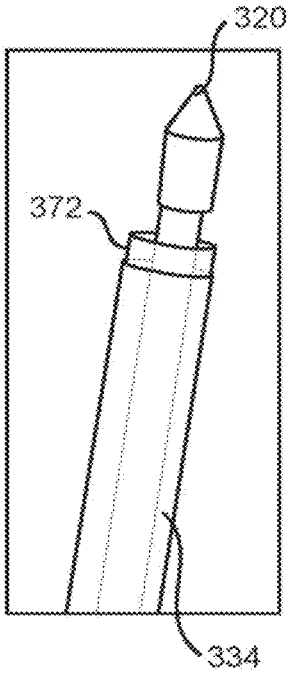
FIG. 21 depicts the absorbent wicking nib being inserted into the interchangeable wicking nib marker of FIG. 20.
Figure 22:
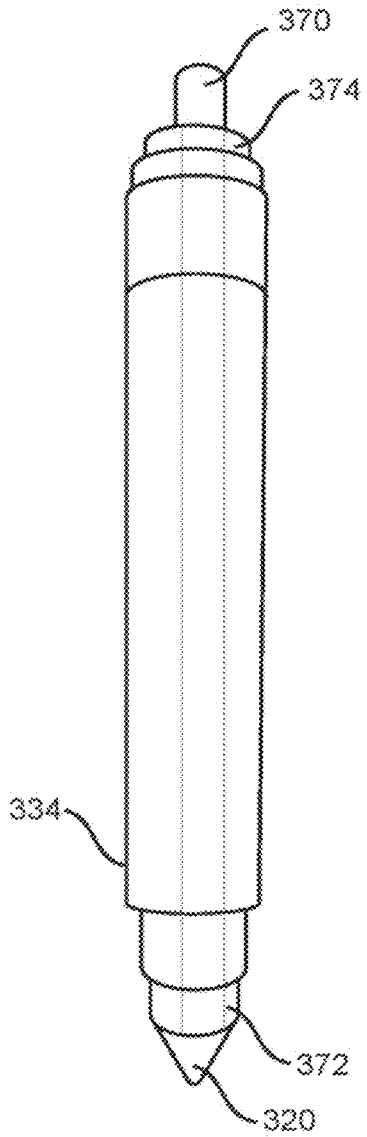
FIG. 22 is a side view of the interchangeable wicking nib marker of FIG. 20 with the wicking nib inserted into the interchangeable wicking nib marker.
Figure 23:
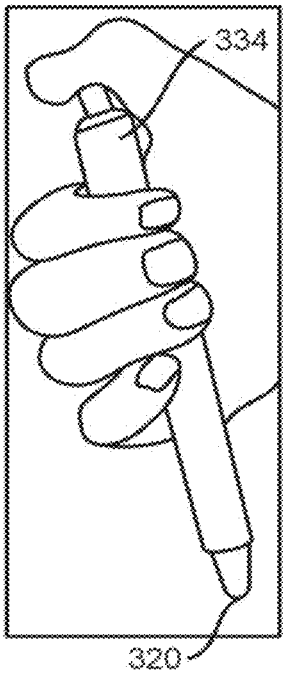
FIG. 23 depicts the plunger mechanism of the interchangeable wicking nib marker of FIG. 21 being deployed to eject the absorbent wicking nib.
Figure 24:
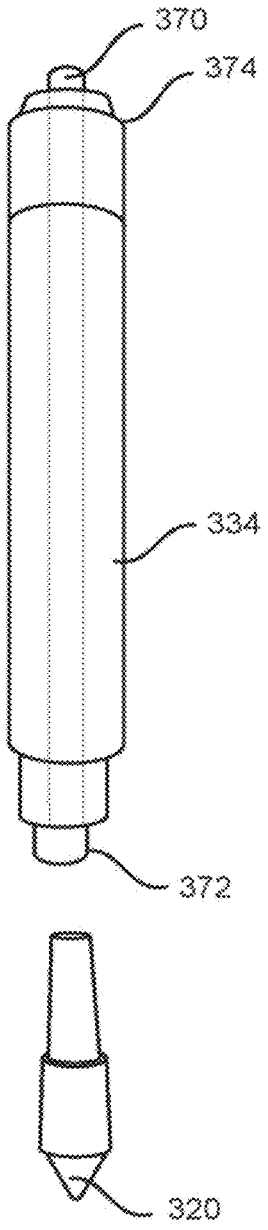
FIG. 24 depicts the ejection of the loaded wicking nib from the interchangeable wicking nib marker of FIG. 20.
Figure 25:
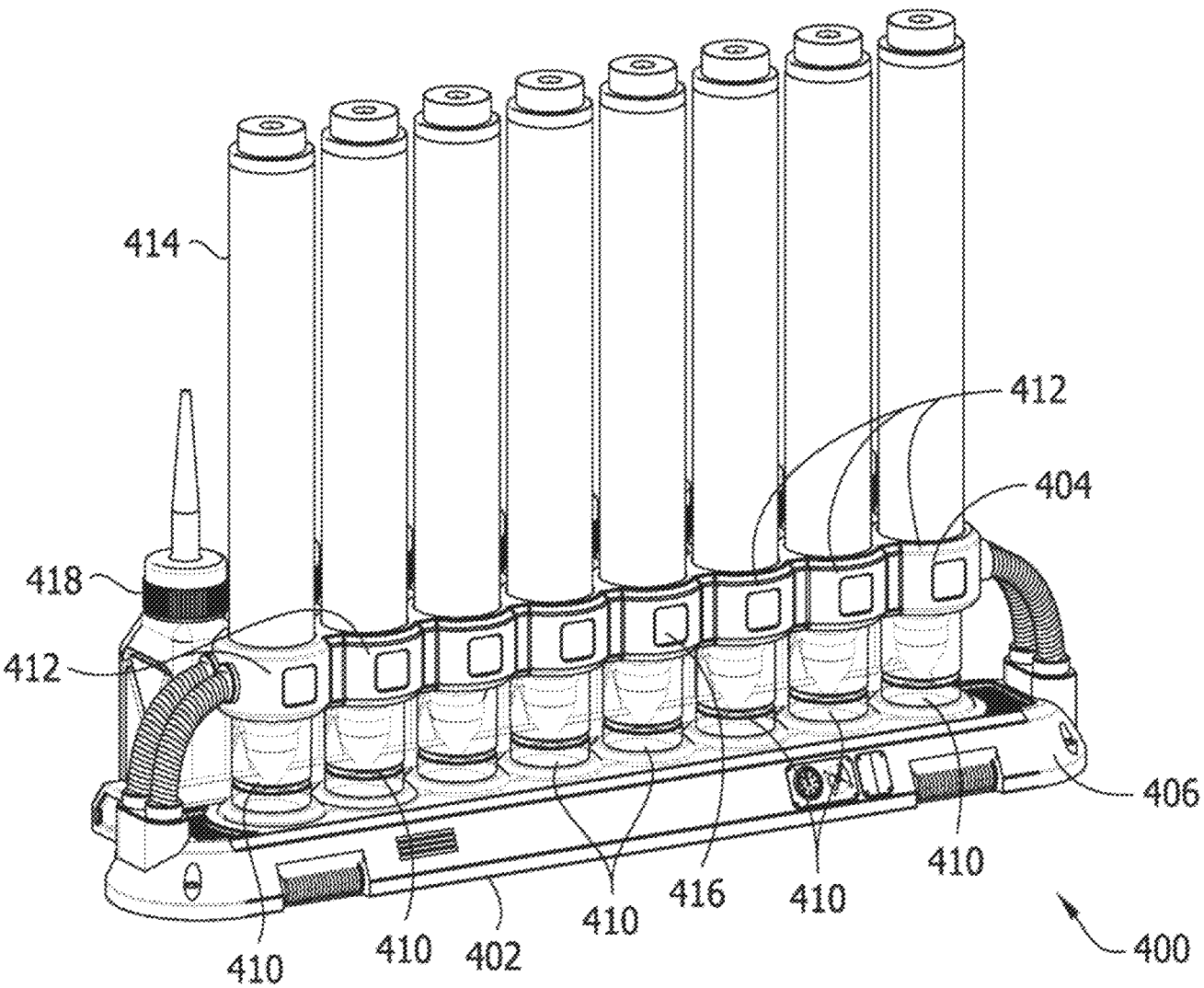
FIG. 25 is a front perspective view of a marker refilling station for refilling the nibs of colored markers in accordance with an exemplary embodiment, and depicting the colored markers in position within each color ink well of the refilling stations.
Figure 26:
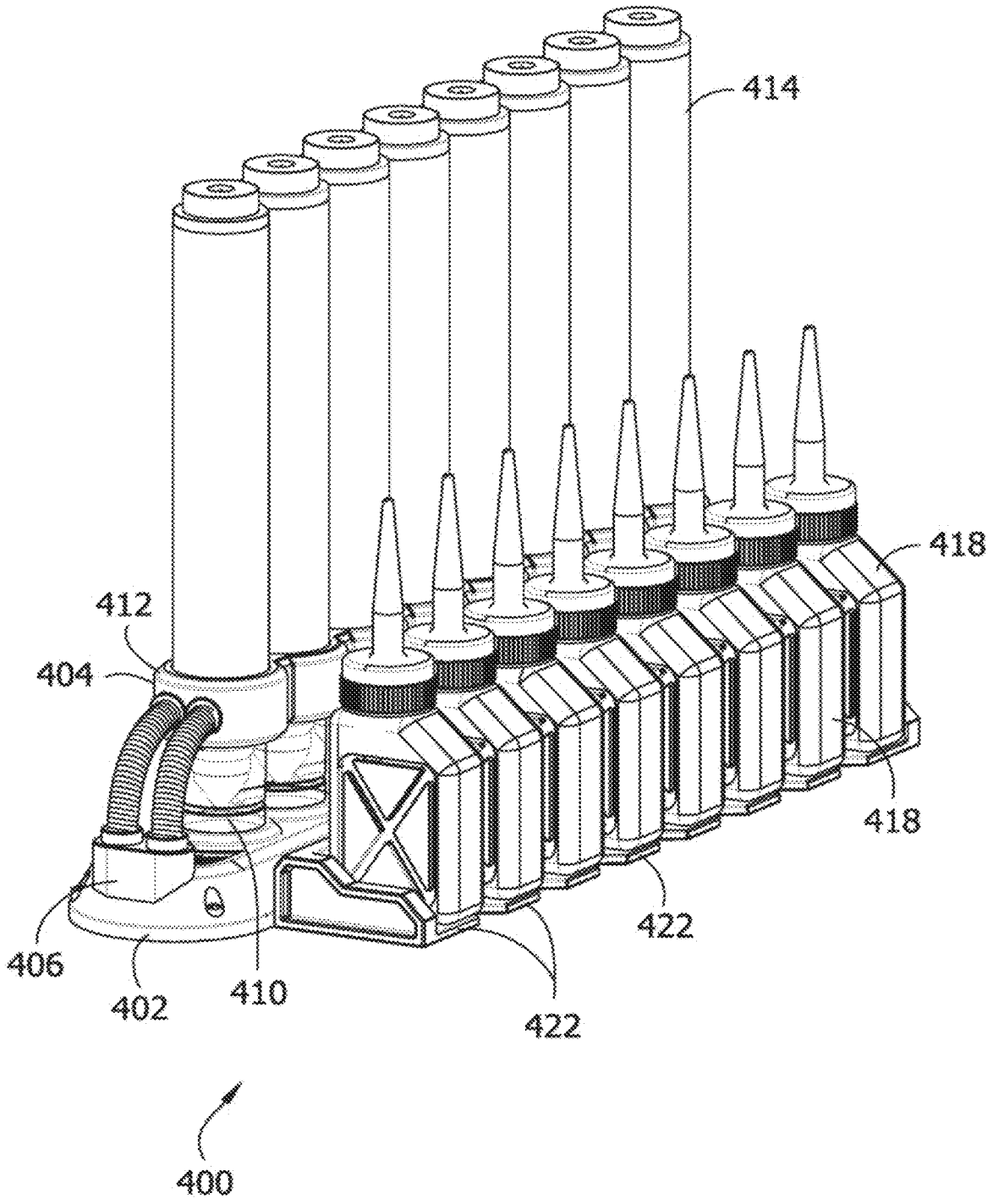
FIG. 26 is a rear perspective view of the marker refilling station of FIG. 25.
Figure 27:
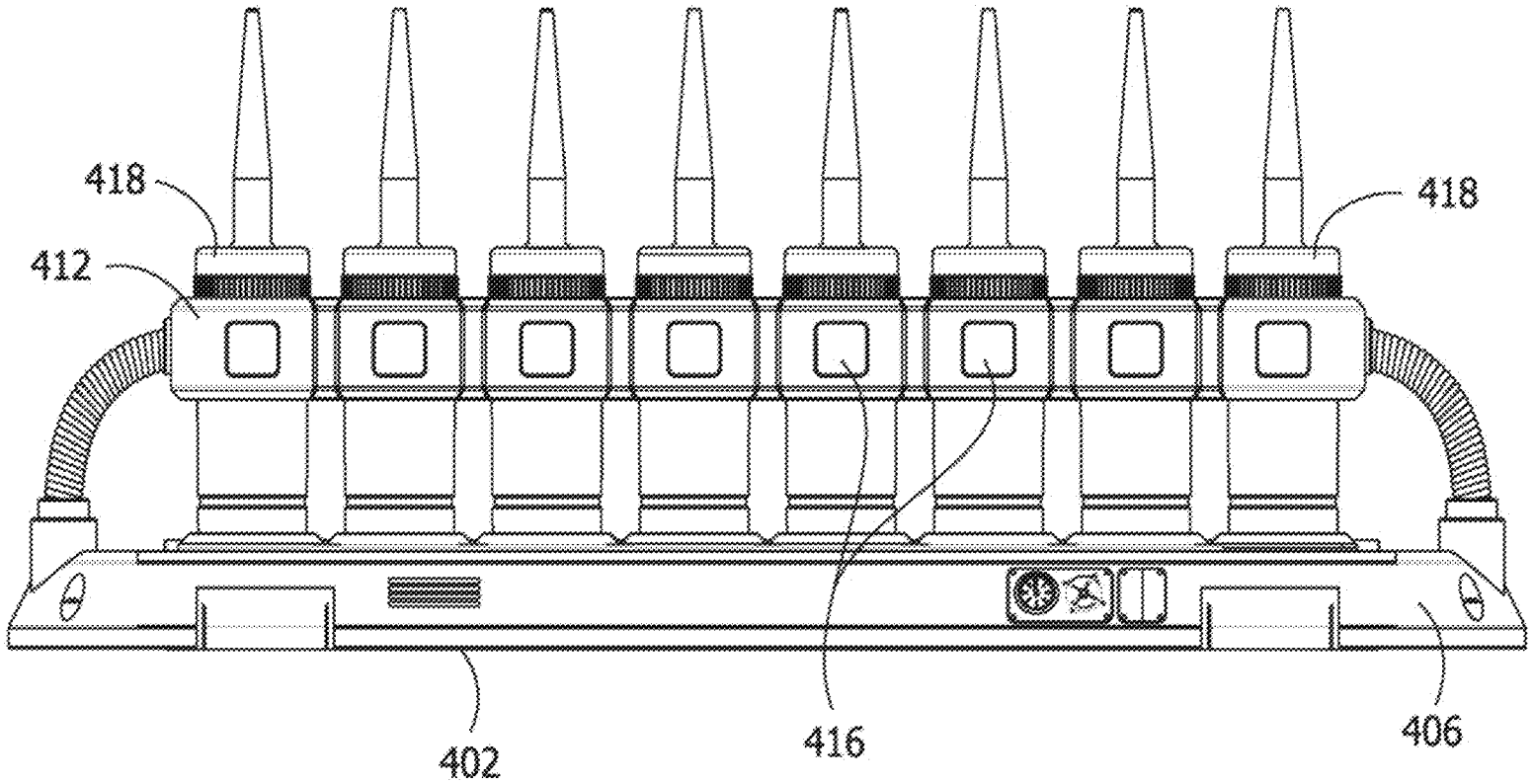
FIG. 27 is a front view of the marker refilling station of FIG. 26, without colored markers in the color ink wells of the refilling station.
Figure 28:
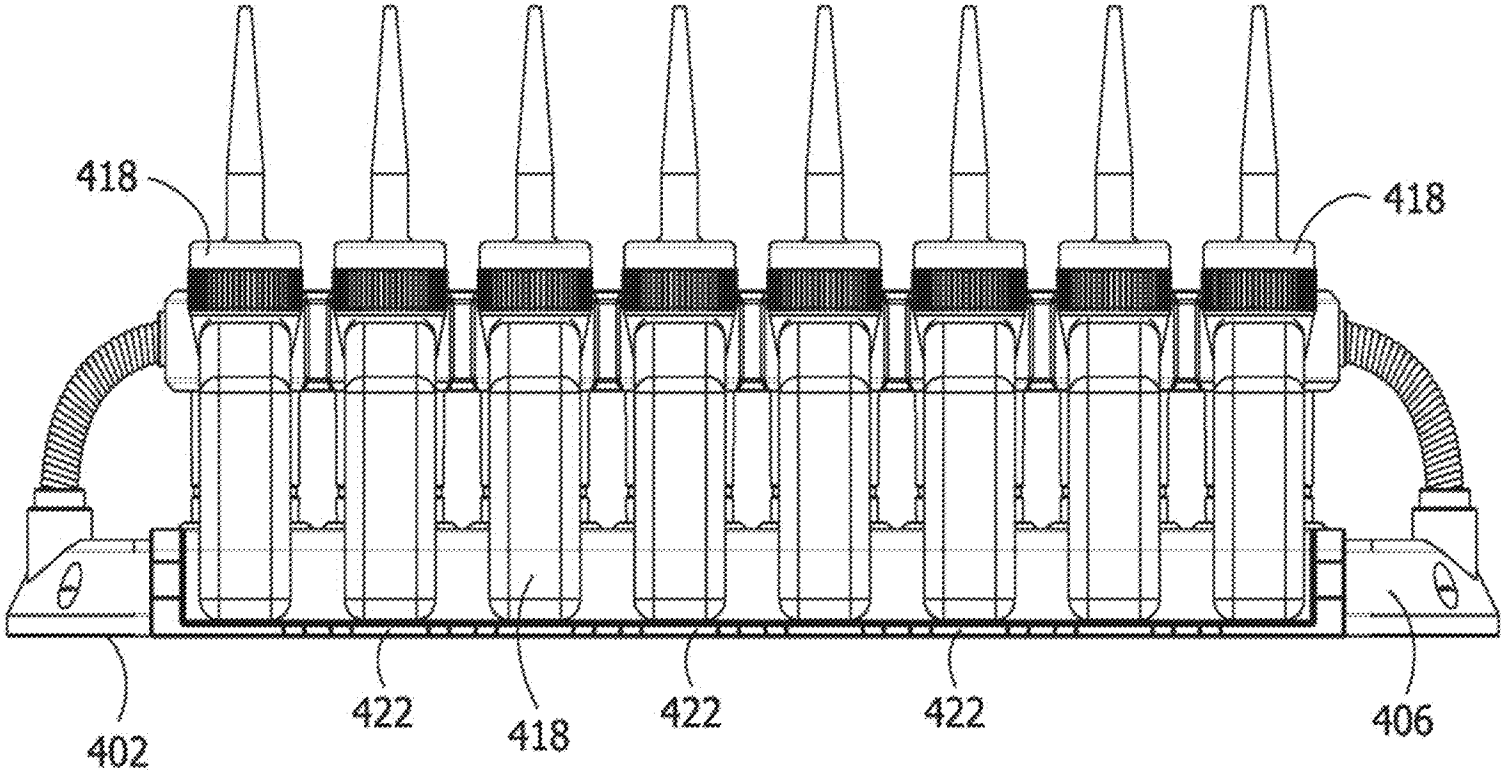
FIG. 28 is a rear view of the marker refilling station of FIG. 27.
Figure 29:
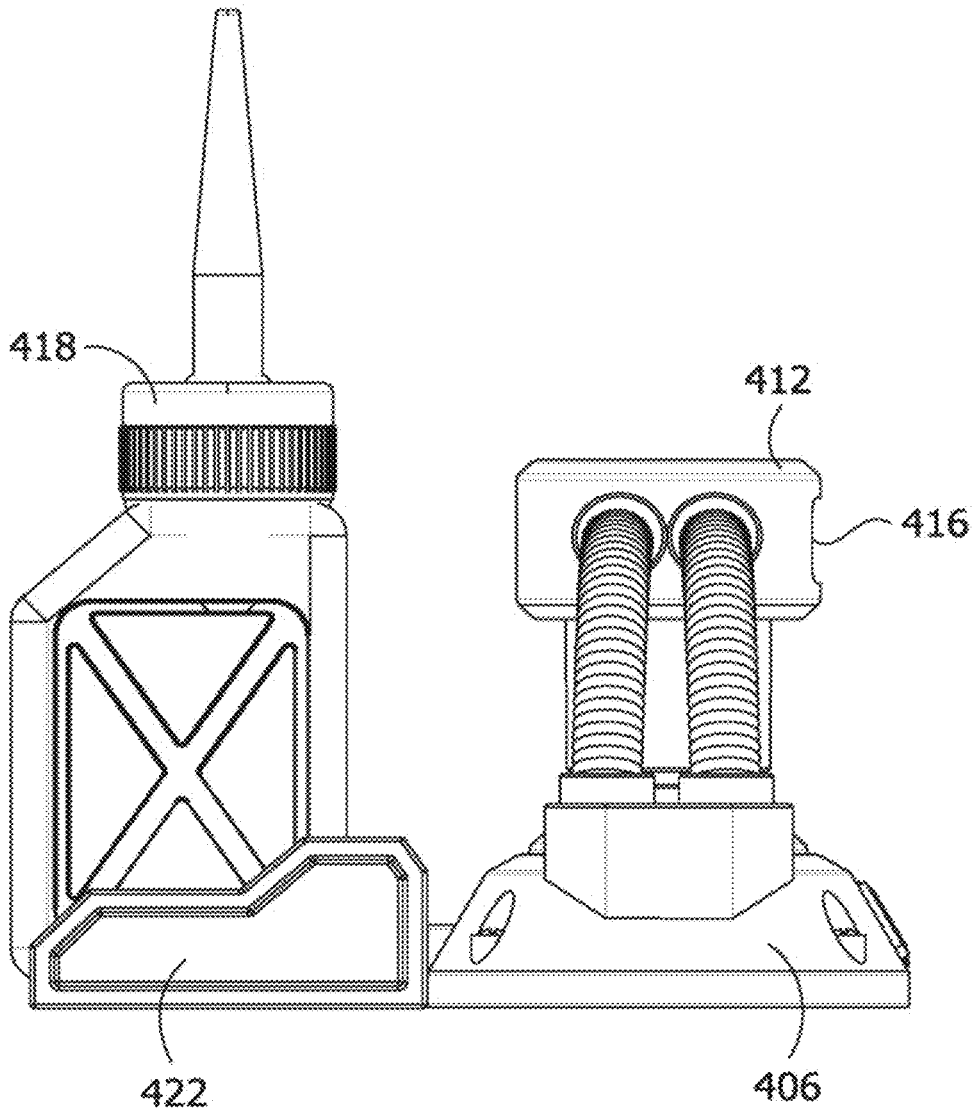
FIG. 29 is a side view of the marker refilling station of FIG. 27.
Figure 30:
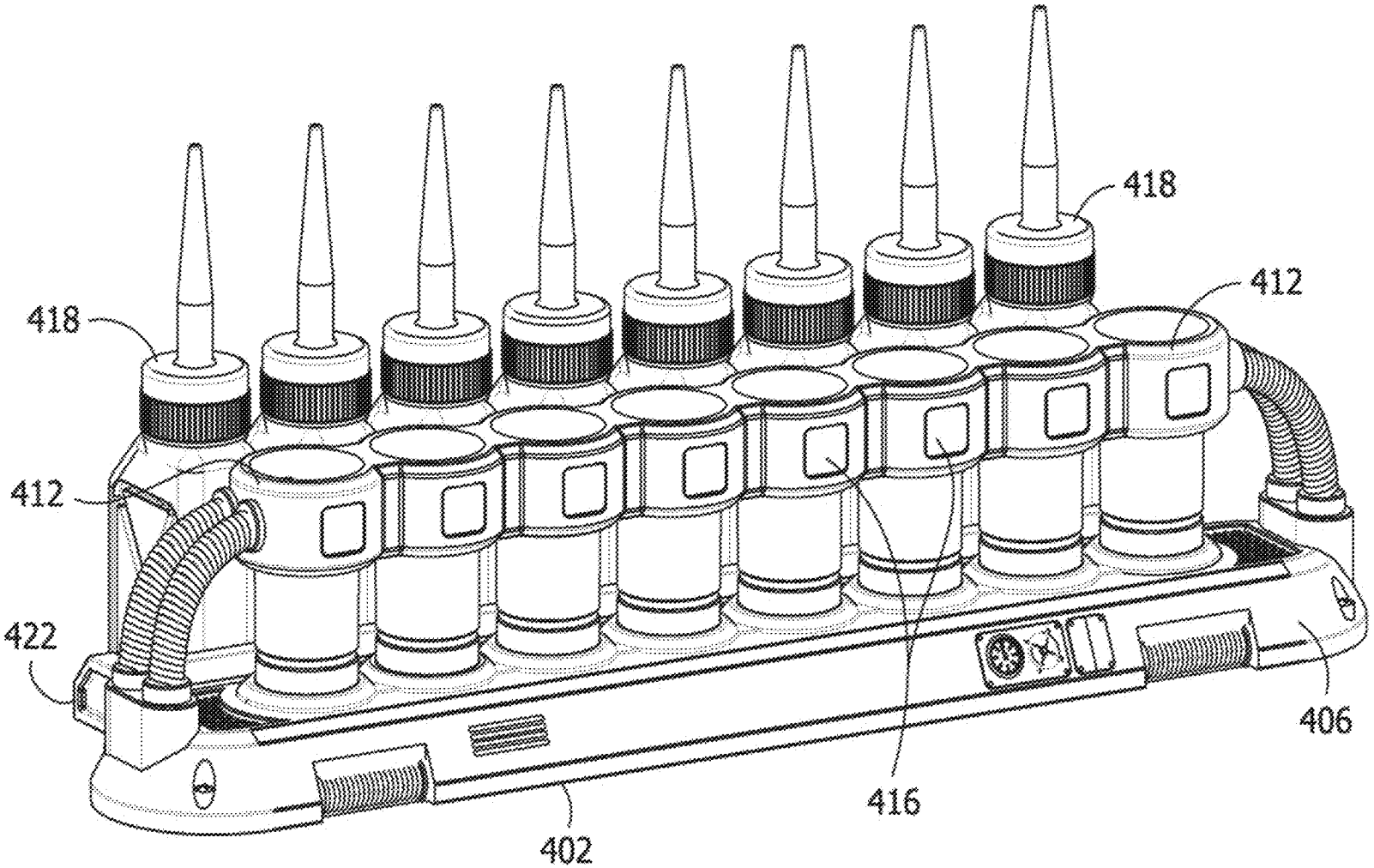
FIG. 30 is a front perspective view of the marker refilling station of FIG. 27.
Figure 31:
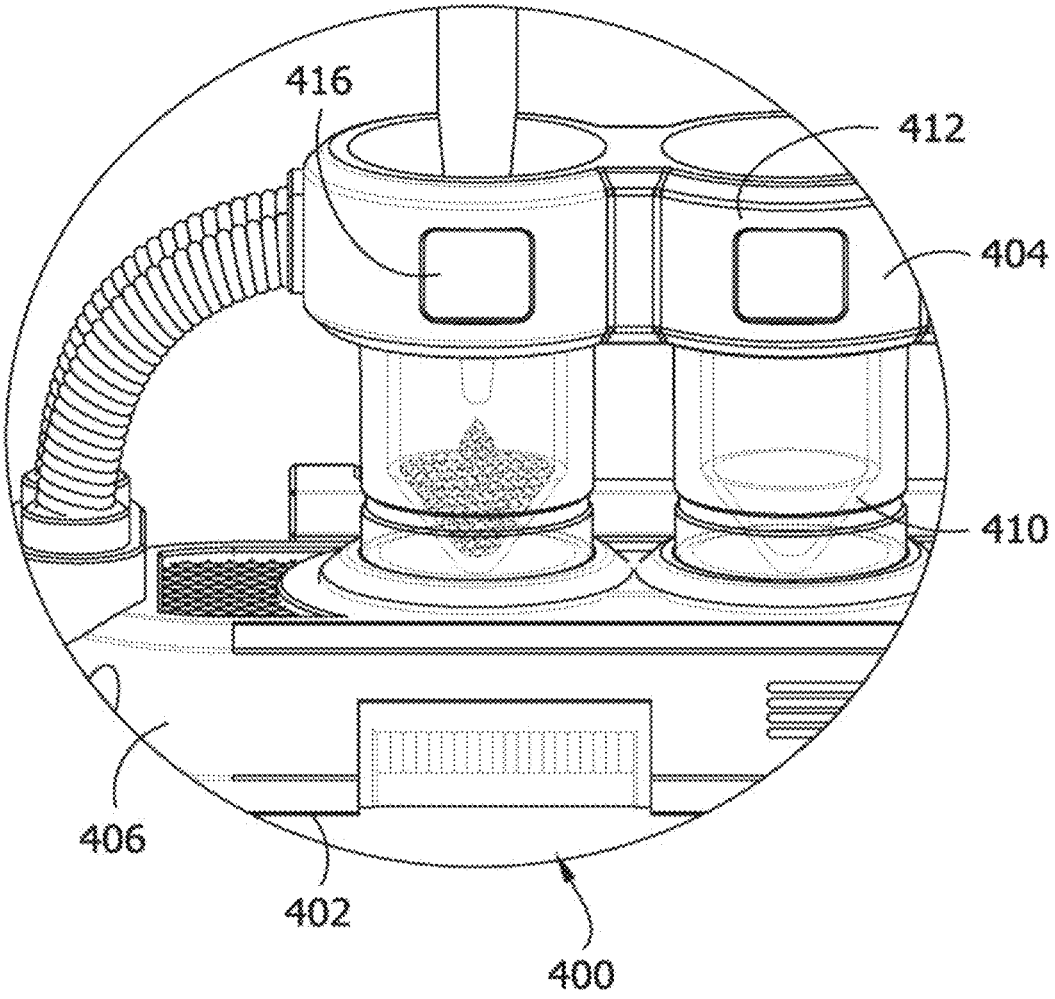
FIG. 31 is an enlarged view of two color ink wells of the marker refilling station depicting colored ink being added to one of the wells.

In practice, a user places the barrel of a marker in the cradle 1114 of one half 1104*a* such that the nib 1116 of the marker 1118 is in contact with ink pad 1112. Then, a user selects another half 1104*b* and connects the two halves together, fully enclosing the nib 1116. Over time, the nib 1116 wicks ink from ink pads 1112. After the marker nib is saturated, the user can separate halves 1104*a*, 1104 to release marker 1118 to provide a dual-colored marker (where ink pads 1112 of the two halves 1104*a*, 1104*b* are different colors). FIG. 19 illustrates a marker having a dual-colored nib and the different colored lines can be drawn with the dual-colored marker.

FIGS. 20-24 depict an exemplary wicking nib housing 334, with a plunger mechanism 370 and an absorbent wicking nib 320 in various positions. In these examples, the "clean" nib 320 is loaded into a first end 372 of the housing 334, and the plunger 370 extends out of the opposite end 374 of the housing. After absorbing two different colors of marker ink, the colored nib 320 may be secured by the housing 334 and drawn on a surface, like a standard marker device. Subsequently, once the ink from the wicking nib 320 has been used up, or the user desires to saturate a different wicking nib 320, the plunger device 370 may be activated by pressure near the second end 374 of the housing, to dispense the saturated (or fully used) wicking nib 320 and clear the first end 372 of the housing 334 for insertion of the next nib 320. Accordingly, the wicking nib housing 334 may include a nib ejector (plunger) 370 that is optionally spring-loaded and that is triggered by a user to manually eject the nib 320 from the housing 334. In further aspects, the wicking nib housing 334 comprises a central rod extending out from the end-plug portion of the positioner barrel, and through the barrel toward the nib, such that when the pressure is applied to the central rod proximate the end plug portion of the device, the resulting action triggers the ejecting of the current nib, emptying the chamber for subsequent insertion of a second nib. Once the second nib is inserted, in some aspects, the center rod may be pushed back out the end plug portion upon pressure from the nib toward the end plug.

In further aspects, a wicking nib structure may be a single-use wicking nib, with a desired porosity at particular depths within the nib structure. In other embodiments, the wicking nib may be a multi-use nib structure that is washable, having a porosity that both absorbs and retains ink, as well as releases residual ink once the nib is washed clean. In yet another embodiment, the material type, porosity, and/or density of a wicking nib structure may be variable throughout the nib structure to provide optimal wicking and laydown, such as a variable-density wicking nib having a plurality of zones of different porous plastic properties, different fibers changing different characteristics like wicking speed and ink fill volume, and a combination of material type, density, porosity, and shape, optimized for contact transfer of ink. For example, in exemplary wicking nibs having variable material type, porosity, and/or density. In some aspects, the material type can include polyester fibers with a porosity is from about 40% to about 70% in one zone and a porosity from another value selected from about 40% to about 70% in another zone.

FIGS. 25-31 depict another aspect of the present disclosure corresponding to a marker refilling station generally indicated at reference 400. In general, marker refilling station 400 can be used to revive used, dried markers with fresh ink. In some instances, the same colored ink as the original marker can be used. In other instances, a different colored ink can be used to provide a mixed color. Marker refilling station generally comprises an elongate housing 402. The elongate housing 402 has a top portion 404 and a bottom portion 406.

The bottom portion 406 of the housing 402 contains a plurality of ink chambers 410. Ink chambers 410 are generally cylindrical in shape and sized and shaped to receive the nib of a marker. In certain aspects, the ink chamber 410 is sized and shaped to receive a broad line marker nib. In other aspects, the ink chamber 410 is customizable in size and shape to allow insertion of a variety of different types and sizes of marker nibs. In certain embodiments, the ink chamber 410 includes a fill line indicia indicating the amount of ink necessary to refill a standard marker (e.g., about 2.5 mL of ink for a broad line marker).

The top portion 404 of the housing 402 contains a plurality of marker collars 412. Ink chambers 410 are coupled to marker collars 412 so that when a marker barrel 414 is placed in the marker collar 412, the nib of the marker rests in ink chamber 410. Thus, marker collars 412 are typically complementary in shape and size to the nib end of the marker barrel 414. For example, marker collars 412 may be sized and shaped to induce a snap fit with the marker barrel 414, similar to the snap fit of a marker cap with a marker barrel. In general, ink chambers 410 and marker collars 412 are oriented so that when a marker 414 is placed therein, the marker barrel 414 is generally vertical in orientation. In various embodiments, the top portion 404 of housing 402 contains color indicia 416 on the exterior of each marker collar 412 to indicate the color of ink in the ink chamber 410.

The plurality of ink chambers 410 generally correspond in number to the number of marker collars 412. For example, in certain embodiments, the marker refilling station 400 includes 4, 5, 6, 7, 8, 9, or 10 ink chambers 410 and corresponding marker collars 412. Preferably, the marker refilling station 400 contains 8 ink reservoirs and 8 marker chambers 410.

In certain embodiments, the housing 402 can also contain a plurality of ink bottle wells 422 in which to place ink bottles 418. Accordingly, ink bottle wells 422 are generally sized and shaped to receive ink bottles 418. The number of ink bottle wells 422 generally correspond in number to the ink chambers 410 and marker collars 412. The color indicia 416 generally correspond to the color of ink bottles 418. In various embodiments, the ink bottle wells 422 are adjacent to ink chamber 410 and marker collar 412.

Figure 32:
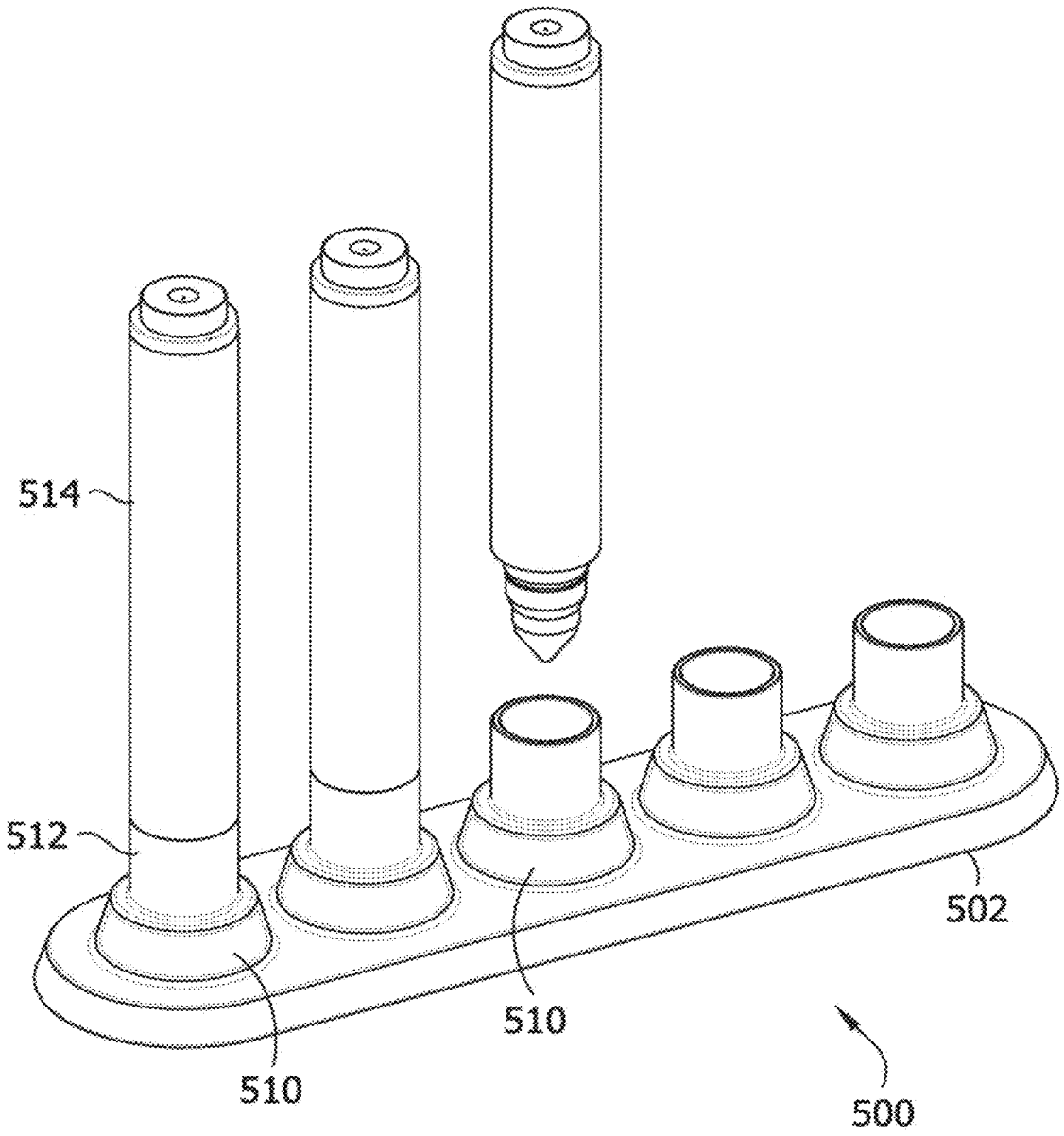
FIG. 32 is a perspective view of a marker refilling station in accordance with another exemplary embodiment depicting two colored markers within corresponding color ink wells and one colored marker in position to be inserted into a corresponding color ink well.

FIG. 32 illustrates another exemplary embodiment of a marker refilling station 500 according to the present disclosure. The station 500 is similar to the station 400 described above but with a more simplified design, and corresponding parts are indicated by corresponding reference numbers plus 100.

Figure 33:
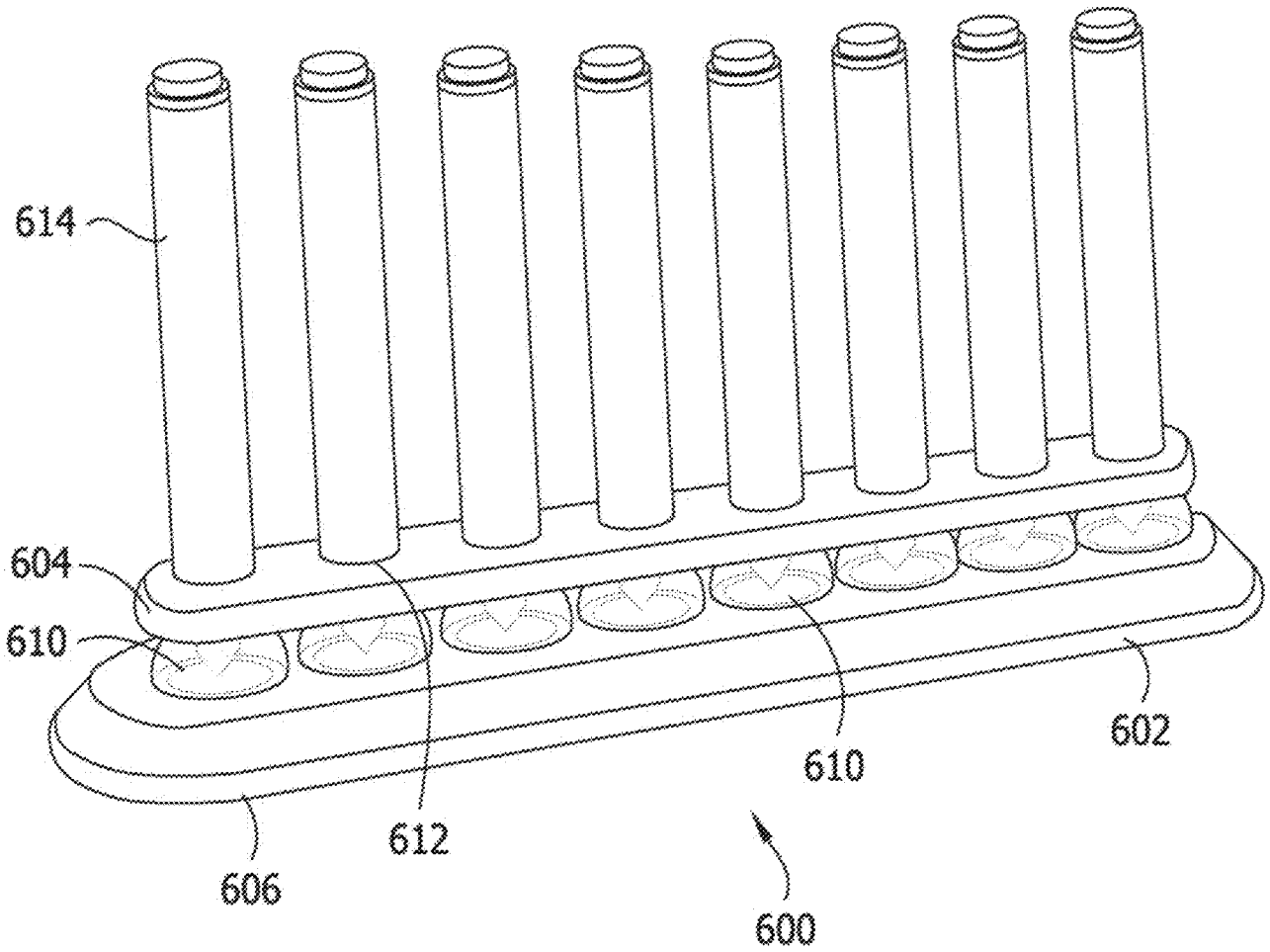
FIG. 33 is a perspective view of a marker refilling station for refilling the nibs of colored markers in accordance with another exemplary embodiment, and depicting the colored markers in position within each color ink well of the refilling stations.

FIG. 33 illustrates another exemplary embodiment of marker refilling station 600 according to the present disclosure. The station 600 is similar to station 400 described above but with a more simplified design, and corresponding parts are indicated by corresponding reference numbers plus 200.

Figure 34:
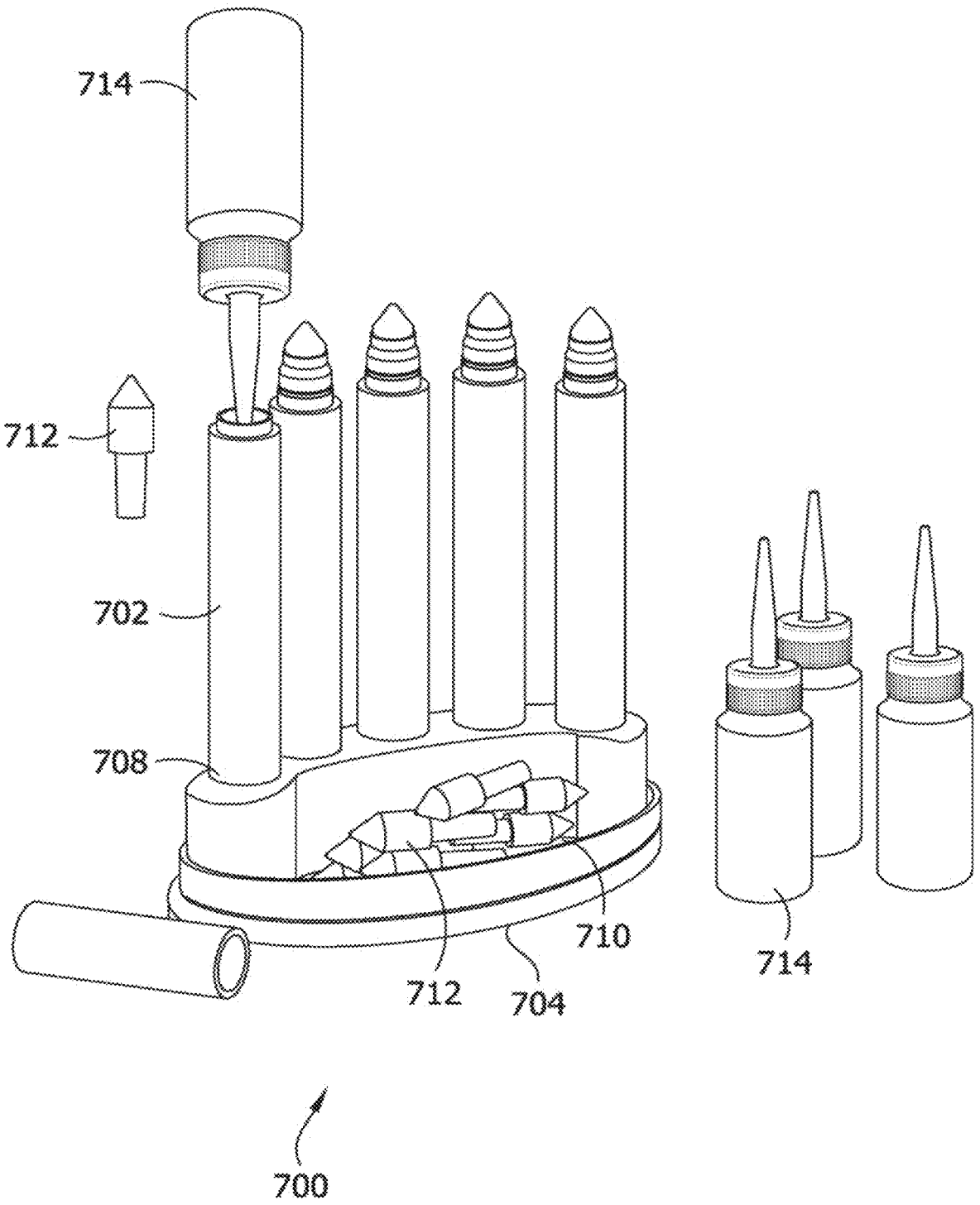
FIG. 34 depicts a system or kit for refilling an ink reservoir of a colored marker including a marker refilling station, blank nibs and ink bottles.
Figure 35:
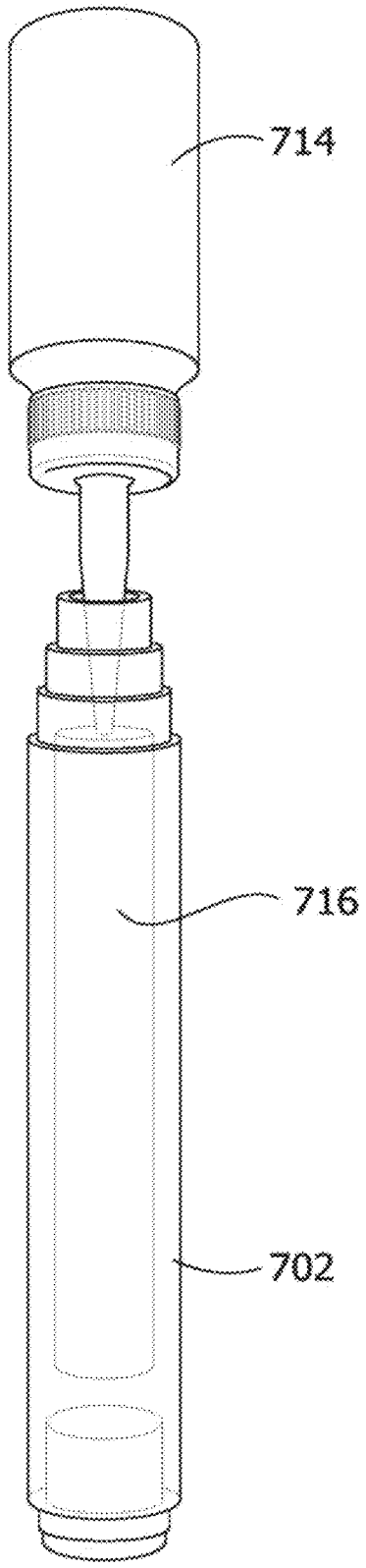
FIG. 35 is a perspective transparent view of a marker reservoir being refilled using the marker refilling station of FIG. 34.

FIGS. 34 and 35 illustrate another exemplary embodiment of marker refilling station 700 according to the present disclosure. Marker refilling station 700 can be used to refill the ink reservoir of the marker 702 as opposed to refilling the nib alone. Marker refilling station 700 generally comprises a base 704 comprising barrel chambers 708 and a storage compartment 710 for unused nibs 712. In general, barrel chambers 708 are sized and shaped to receive a bottom end (opposite the nib end) of the barrel of a marker 702, which secures the marker during refill. A portion of the barrel of the marker 702 enters the barrel chamber 708 to allow for increased stability. A marker refilling station can comprise any number of barrel chambers 708 as appropriate, for example, 4, 5, 6, 7, 8, 9, or 10 barrel chambers 708, to allow for refill of multiple markers at the same time.

The marker refilling station 700 also includes a plurality of ink bottles 714, which can vary in color. In practice, a user places the bottom end of a marker in the marker chamber 708 and manually removes the used nib 712. Then, using the ink bottle 714, the user inserts fresh ink into the barrel of marker 702, saturating the ink reservoir 716 of marker 702. Once the ink reservoir 716 is saturated with new ink, a new, unused nib 712 can be inserted into the top end of marker 702 and marker 702 can be removed from marker chamber 708. Over time, ink will wick into the new nib 712 of marker 702 to allow for use of the refreshed marker.

Since many possible embodiments may be made of the technology described herein without departing from the scope thereof, it is to be understood that all matter herein set forth or shown in the accompanying drawings is to be interpreted as illustrative and not in a limiting sense. Alternatively, the aspects described throughout this specification are intended in all respects to be illustrative rather than restrictive. Upon reading the present disclosure, alternative aspects will become apparent to ordinary skilled artisans that practice in areas relevant to the described aspects without departing from the scope of this disclosure. In addition, aspects of this technology are adapted to achieve certain features and possible advantages set forth throughout this disclosure, together with other advantages which are inherent. It will be understood that certain features and subcombinations are of utility and may be employed without reference to other features and subcombinations. This is contemplated by and is within the scope of the claims.

Having described the invention in detail, it will be apparent that modifications and variations are possible without departing from the scope of the invention defined in the appended claims.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products and methods without departing from the scope of the invention, it is intended that all matter contained in the above description and shown in the accompanying drawings shall be interpreted as illustrative and not in a limiting sense.

The invention claimed is:

1. A wicking kit for supplying color to the nib of a marker, the kit comprising:

a first ink pad; and a second ink pad;

wherein the first ink pad and second ink pad are configured to be removeably joined in abutting contact with one another along a mating edge on the first ink pad and a mating edge on the second ink pad;

wherein the first ink pad includes a first well positioned along the mating edge of the first ink pad and the second ink pad includes a second well positioned along the mating edge of the second ink pad, such that when the first ink pad and the second ink pad are joined in contact with one another the first and second wells together define a positioning aperture; and wherein the positioning aperture is sized and shaped to receive a marker nib with a first portion of a sidewall of the marker nib in contact with the first ink pad and second portion of the sidewall of the marker nib in contact with the second ink pad.

2. The wicking kit of claim 1, wherein said first well and second well are semi-circular in shape.

3. The wicking kit of claim 2, wherein said first well and second well are conical in shape.

4. The wicking kit of claim 2, wherein said kit comprises a plurality of different colored inks that can each be added to any one or more of the ink pads.

5. The wicking kit of claim 1, wherein the positioning aperture is sized and shaped to snugly receive a nib of a marker with a majority of the sidewall of the nib extending from the tip end to a base of the nib on one side of the nib is in contact with the first ink pad and a majority of the sidewall of the nib extending from the tip end to a base of the nib on an opposite side of the nib is in contact with the second ink pad.

6. The wicking kit of claim 1, wherein each ink pad comprises a housing and an absorbent pad wherein the housing surrounds a bottom surface and a portion of side surfaces of the absorbent pad.

7. The wicking kit of claim 6, wherein the first ink pad and second ink pad are configured to be releasably coupled in abutting contact with one another along their respective mating edges.

8. The wicking kit of claim 7, wherein the housing of said first and second ink pads comprises mating tabs and apertures for releasably coupling in abutting contact with one another along their respective mating edges.

* * * * *